US006332834B1

(12) United States Patent
Nukui et al.

(10) Patent No.: US 6,332,834 B1
(45) Date of Patent: Dec. 25, 2001

(54) METHOD AND APPARATUS FOR GRINDING A WORKPIECE

(75) Inventors: Mitsuru Nukui, Toyama; Shirou Murai, Kanagawa; Michihiro Takata, Toyama; Tetsuo Okuyama, Kanagawa; Muneaki Kaga, Toyama; Toyotaka Wada, Kanagawa, all of (JP)

(73) Assignee: Nippei Toyama Corporation, Tokyo (JP)

( * ) Notice: Subject to any disclaimer, the term of this patent is extended or adjusted under 35 U.S.C. 154(b) by 0 days.

(21) Appl. No.: 09/538,968

(22) Filed: Mar. 31, 2000

(30) Foreign Application Priority Data

Mar. 31, 1999 (JP) ..... 11-091947
Aug. 3, 1999 (JP) ..... 11-220019

(51) Int. Cl.[7] ..... B24B 1/00
(52) U.S. Cl. ..... 451/57; 451/8; 451/44
(58) Field of Search ..... 451/44, 43, 57, 451/65, 178, 182, 246, 258, 8

(56) References Cited

U.S. PATENT DOCUMENTS

| | | | | |
|---|---|---|---|---|
| 4,656,787 | * | 4/1987 | Ueda et al. | 451/143 |
| 4,793,101 | | 12/1988 | Dlouhy et al. | 51/283 E |
| 5,185,965 | | 2/1993 | Ozaki | 51/283 E |
| 5,295,331 | * | 3/1994 | Honda et al. | 451/44 |
| 5,462,361 | * | 10/1995 | Sato et al. | 384/9 |
| 5,490,811 | * | 2/1996 | Hosokawa | 451/239 |
| 5,547,414 | * | 8/1996 | Ohmori | 451/21 |
| 5,609,514 | * | 3/1997 | Yasunaga et al. | 451/65 |
| 5,730,643 | * | 3/1998 | Bartlett et al. | 451/8 |
| 5,738,563 | * | 4/1998 | Shibata | 451/5 |
| 5,975,992 | * | 11/1999 | Raeder et al. | 451/44 |
| 6,223,635 | * | 5/2001 | Tonooka et al. | 82/1.11 |

FOREIGN PATENT DOCUMENTS

| | | | |
|---|---|---|---|
| 0 759 339 A1 | 2/1997 | (EP) | B24B/9/00 |
| 0 868 968 A2 | 10/1998 | (EP) | B24B/7/22 |
| 63-22259 | 1/1988 | (JP) | B24B/9/00 |
| 63-113560 | 7/1988 | (JP) | B24D/5/14 |
| 4-129656 | 4/1992 | (JP) | B24B/9/00 |
| 5-123952 | 5/1993 | (JP) | B24B/9/00 |
| 7-40213 | 2/1995 | (JP) | B24B/9/00 |
| 2555000 | 8/1996 | (JP) | B24B/7/17 |
| 9-168953 | 6/1997 | (JP) | B24B/9/00 |
| 9-232257 | 9/1997 | (JP) | H01L/21/304 |
| 11-33918 | 2/1999 | (JP) | B24D/5/02 |
| 2000-52210 | 2/2000 | (JP) | B24B/9/00 |

* cited by examiner

*Primary Examiner*—Joseph J. Hail, III
*Assistant Examiner*—David B. Thomas
(74) *Attorney, Agent, or Firm*—Sughrue Mion, PLLC

(57) ABSTRACT

A workpiece 23 formed of a circular thin plate is rotated about its center as an axis L1. Each of disk-shaped rotating grinding wheels 27 and 28, while being rotated about an axis L3 extending in a direction substantially parallel to the plane of the workpiece 23 and perpendicular to the radial direction of the workpiece 23, is made to undergo relative feeding movement on both obverse and reverse surface sides of the workpiece 23 along an outer peripheral edge portion 23*a* of the workpiece 23. Consequently, the outer peripheral edge portion 23*a* of the workpiece 23 is ground by an outer peripheral surface of each of the rotating grinding wheels 27 and 28. In this case, it is preferred that two grinding wheels 27 and 28 for rough grinding and finish grinding be provided as the disk-shaped rotating grinding wheels, and that rough grinding and finish grinding are performed by the same station.

23 Claims, 16 Drawing Sheets

METHOD AND APPARATUS FOR GRINDING A WORKPIECE

BACKGROUND OF THE INVENTION

1. Field of the Invention

The present invention relates to a method and an apparatus for grinding a workpiece, specifically, for grinding an outer peripheral edge of a workpiece formed of a circular thin plate such as a semiconductor wafer.

2. Description of the Related Art

Conventionally, in a case where this type of workpiece formed of a circular thin plate is ground, a grinding method such as the one shown in FIG. 16 has been adopted. Namely, in this conventional method, a workpiece 71 is rotated about its center as an axis L1, and a forming grinding wheel 72 is moved so as to be fed toward an outer peripheral edge portion 71*a* of the workpiece 71 while being rotated about an axis L2 which is parallel to the central axis L1 of the workpiece 71. As a result, the outer peripheral edge portion 71*a* of the workpiece 71 is ground by a recessed wheel surface 72*a* of the outer periphery of the forming grinding wheel 72.

However, with this conventional method of grinding a workpiece, since the outer peripheral edge portion 71*a* of the workpiece 71 is arranged to be ground at one time by the recessed wheel surface 72*a* of the forming grinding wheel 72, the recessed wheel surface 72*a* of the forming grinding wheel 72 has been liable to become worn, and the deformation of its profile has been liable to occur as a result. For this reason, particularly in finishing, it is extremely difficult to maintain constant the machining accuracy of the profiles of the outer peripheral edge portions 71*a* of a multiplicity of workpieces 71 by a single forming grinding wheel 72, and it has been necessary to replace the forming grinding wheel 72 frequently, so that there have been problems in terms of the machining accuracy and machining cost.

SUMMARY OF THE INVENTION

The invention has been devised in light of the above-described problems which are present in the conventional art. Its object is to provide a method of and an apparatus for grinding a workpiece which make it possible to grind outer peripheral edge portions of workpieces while maintaining constant machined shape accuracy, and which make it unnecessary to replace the grinding wheel frequently.

To solve the above object, according to a first aspect of the invention, there is provided a method of grinding a workpiece, a workpiece formed of a circular thin plate is rotated about its center as an axis, and each of the disk-shaped rotating grinding wheels, while being rotated about an axis substantially parallel to the plane of the workpiece, is made to undergo relative feeding movement on both obverse and reverse surf ace sides of the workpiece along the outer peripheral edge portion of the workpiece. Consequently, the outer peripheral edge portion of the workpiece is ground by the outer peripheral wheel surface of each of the rotating grinding wheels.

In this connection, the wording "the rotating grinding wheel" includes a pad, and the wording "grinding" includes polishing. And, these wordings are used as well in the below description.

In addition, the above relative feeding movement is performed such that the grinding wheel continuously moves on at least one part of a predetermined configuration of the edge portion to be ground along a thickness direction of the workpiece.

For this reason, as compared with the conventional grinding method in which the outer peripheral edge portion of the workpiece is ground by a forming grinding wheel, the profile of the wheel surface of each of the rotating grinding wheels is less prone to deformation, so that it be comes unnecessary to replace the rotating grinding wheels frequently. Accordingly, it is possible to reduce the material cost of the rotating grinding wheels, and hence the machining cost. Furthermore, since the profile of the wheel surface of each of the rotating grinding wheels is less prone to deformation, the outer peripheral edge portions of the workpieces can be ground into constant machined shapes with high accuracy.

In addition, the edge portion of the workpiece can be finished into an arbitrary shape by the same grinding wheels through the relative feeding control of the workpiece and the rotating grinding wheels.

In the method of grinding a workpiece according to the invention, the axis of the rotating grinding wheels is disposed in such a manner as to be perpendicular to the radial direction of the workpiece. For this reason, the rotation of the workpiece is effected so as to traverse the outer peripheral surface of each of the rotating grinding wheels. In other words, the workpiece undergoes relative movement in the widthwise direction of the rotating grinding wheels. Accordingly, it becomes possible to effectively grind all over the outer peripheral edge portion of the workpiece by making effective use of the overall width of the outer peripheral wheel surfaces of the rotating grinding wheels.

In the method of grinding a workpiece according to the invention, the rotating grinding wheels consist of the two grinding wheels for rough grinding and finish grinding, and rough grinding and finish grinding are performed by the grinding wheels, respectively. For this reason, the grinding of the outer peripheral edge portion of the workpiece can be effected separately for rough grinding and finish grinding and continuously and efficiently with high accuracy.

In the method of grinding a workpiece according to the invention, the rough grinding and finish grinding of the outer peripheral edge portion of the workpiece are performed by the same station. For this reason, it becomes unnecessary to transport the workpiece into another station or shift the holding of the workpiece, and it is possible to continuously perform rough grinding and finish grinding for the outer peripheral edge portion in the state of being disposed in the same station. Hence, it is possible to maintain the positional accuracy of the workpiece and improve the operating efficiency. Further, stations for rough grinding and finish grinding need not be provided separately, the arrangement of the grinding apparatus can be simplified, and the grinding apparatus can be made compact.

In the method of grinding a workpiece according to the invention, a rotating grinding wheel which is formed by binding the grains of silicon dioxide into fixed abrasive grains is used as the rotating grinding wheel for finishing. For this reason, the outer peripheral edge portion of the workpiece can be ground with good finish-ground surface roughness by virtue of the chemical action based on the reducing action of silicon dioxide.

In the method of grinding a workpiece according to the invention, after the outer peripheral edge portion of the workpiece is subjected to rough grinding and finish grinding by using the rotating grinding wheels; final finishing is performed by using the disk-shaped polishing pad and slurry. For this reason, the relatively soft polishing pad are applied, and the slurry always cools the machined portion of the workpiece. Hence, it is possible to further enhance the ground surface roughness of the outer peripheral edge portion of the workpiece and effect super-finish grinding.

In the method of grinding a workpiece according to the invention, an outer peripheral edge portion of the workpiece is ground.

Accordingly, it is possible to obtain the aforementioned operational advantages in the grinding of the outer peripheral edge portion.

In the method of grinding a workpiece according to the invention, an inner peripheral edge portion of the workpiece having a circular hole in its center is ground.

Accordingly, it is possible to obtain the aforementioned operational advantages in the grinding of the inner peripheral edge portion.

In the method of grinding a workpiece according to the invention, a rotating grinding wheel for cylindrical grinding is rotated about an axis parallel to the central axis of the workpiece in a process preceding the grinding by the disk-shaped rotating grinding wheel, so as to effect the rough cutting of the edge portion of the workpiece by cylindrical grinding.

Accordingly, since rough cutting by cylindrical grinding, which makes it possible to secure a large amount of grinding per unit time in a preceding process, is adopted, the grinding can be performed efficiently. Moreover, since this cylindrical grinding is rough cutting, even if the profile of the outer peripheral surface of the rotating grinding wheel for cylindrical grinding is slightly broken, machining accuracy remains substantially unaffected.

In this connection, the rotating grinding wheel for cylindrical grinding includes a forming grinding wheel.

In a second aspect according to the invention, there is provided a method of grinding a workpiece, characterized in that a workpiece formed of a circular thin plate is rotated about its center as an axis, that a rotating grinding wheel for cylindrical grinding is concurrently rotated about an axis parallel to a central axis of the workpiece so as to effect the rough cutting of a edge portion of the workpiece by cylindrical grinding, and that a disk-shaped rotating grinding wheel, while being rotated about an axis extending in a direction substantially parallel to a plane of the workpiece and perpendicular to a radial direction of the workpiece, is subsequently made to undergo relative feeding movement on both obverse and reverse surface sides of the workpiece along an edge portion of the workpiece, so as to grind the edge portion of the workpiece by an outer peripheral surface of the disk-shaped rotating grinding wheel.

Accordingly, since the edge portion of the workpiece is subjected to rough cutting in advance in the preceding process, the subsequent grinding of the edge portion of the workpiece can be performed efficiently. Furthermore, the wheel surface of the disk-shaped rotating grinding wheel is difficult to be worn, so that it is unnecessary to replace the rotating grinding wheel frequently, and the edge portion of the workpiece can be ground into a constant machined shape with high accuracy.

In the method of grinding a workpiece according to the invention, two grinding wheels including one for rough grinding and another for finish grinding are provided as the disk-shaped rotating grinding wheel, and rough grinding and finish grinding are performed after the rough cutting.

Accordingly, the grinding of the edge portion of the workpiece can be effected efficiently with high accuracy by being divided into rough grinding and finish grinding, and the arrangement of the apparatus can be made simple and compact by the joint use of the machining station.

Furthermore, according to a third aspect of the invention, there is provided an apparatus for grinding a workpiece, characterized by comprising: workpiece holding means for holding a workpiece formed of a circular thin plate and for rotating the workpiece about its own axis; and grinding means having a disk-shaped rotating grinding wheel and for causing the rotating grinding wheel, while being rotated about an axis substantially parallel to a plane of the workpiece, to undergo relative feeding movement on both obverse and reverse surface sides of the workpiece along an edge portion of the workpiece, so as to grind the edge portion of the workpiece.

Accordingly, it is possible to realize an apparatus in which the wheel surface of the grinding wheel is difficult to be worn, it is unnecessary to replace the grinding wheel frequently, and the outer peripheral edge portion or the inner peripheral edge portion of the workpiece can be ground into a constant machined shape with high accuracy, as described above.

In addition, the edges of the workpieces can be finished to arbitrary shapes by the same grinding wheel through the relative feed control of the workpiece and the rotating grinding wheel.

In the apparatus for grinding the workpiece according to the invention, a guide mechanism for guiding the relative movement of the workpiece and the rotating grinding wheel for performing the processing is formed by a hydrostatic bearing.

Accordingly, when the grinding wheel and the workpiece are relatively moved, for instance, in a Z direction along the rotational axis of the workpiece and in a Y direction perpendicular thereto, the relative movement of the grinding wheel and the workpiece is effected smoothly by the guide mechanism including the hydrostatic bearing. Accordingly, it is possible to prevent vibrations from occurring during the relative movement of the grinding wheel and the workpiece, thereby making it possible to improve the processing accuracy of the ground surface of the workpiece.

Further, according to a fourth aspect of the invention, the rotating grinding wheel, while being rotated in one direction, is moved to be fed toward the edge portion of the workpiece starting with its obverse surface side and then toward its tip side, to thereby grind the obverse surface side of the edge portion, and, subsequently, the rotating grinding wheel, while being rotated in the opposite direction, is moved to be fed toward the edge portion of the workpiece starting with its reverse surface side and then toward its tip side, to thereby grind the reverse surface side of the edge portion.

In accordance with this grinding method, since grinding is performed by bisecting an allowance for the obverse and reverse surfaces of the edge portion of the workpiece in such a manner as to depict symmetrical loci of movement on the obverse surface side and the reverse surface side, grinding can be performed by the same change of the grinding conditions for both the obverse and reverse surface sides in correspondence with the angle of the crystalline face appearing at the edge portion, and it is possible to prevent the occurrence of variations in the roughness of the ground surface between the obverse surface side and the reverse surface side of the edge portion. Hence, the edge portion of the workpiece can be ground uniform ground surface roughness with high accuracy.

DETAILED DESCRIPTION OF THE PREFERRED EMBODIMENTS

Referring now to FIGS. 1 to 9B, a description will be given of an embodiment of the invention.

Figure 1:
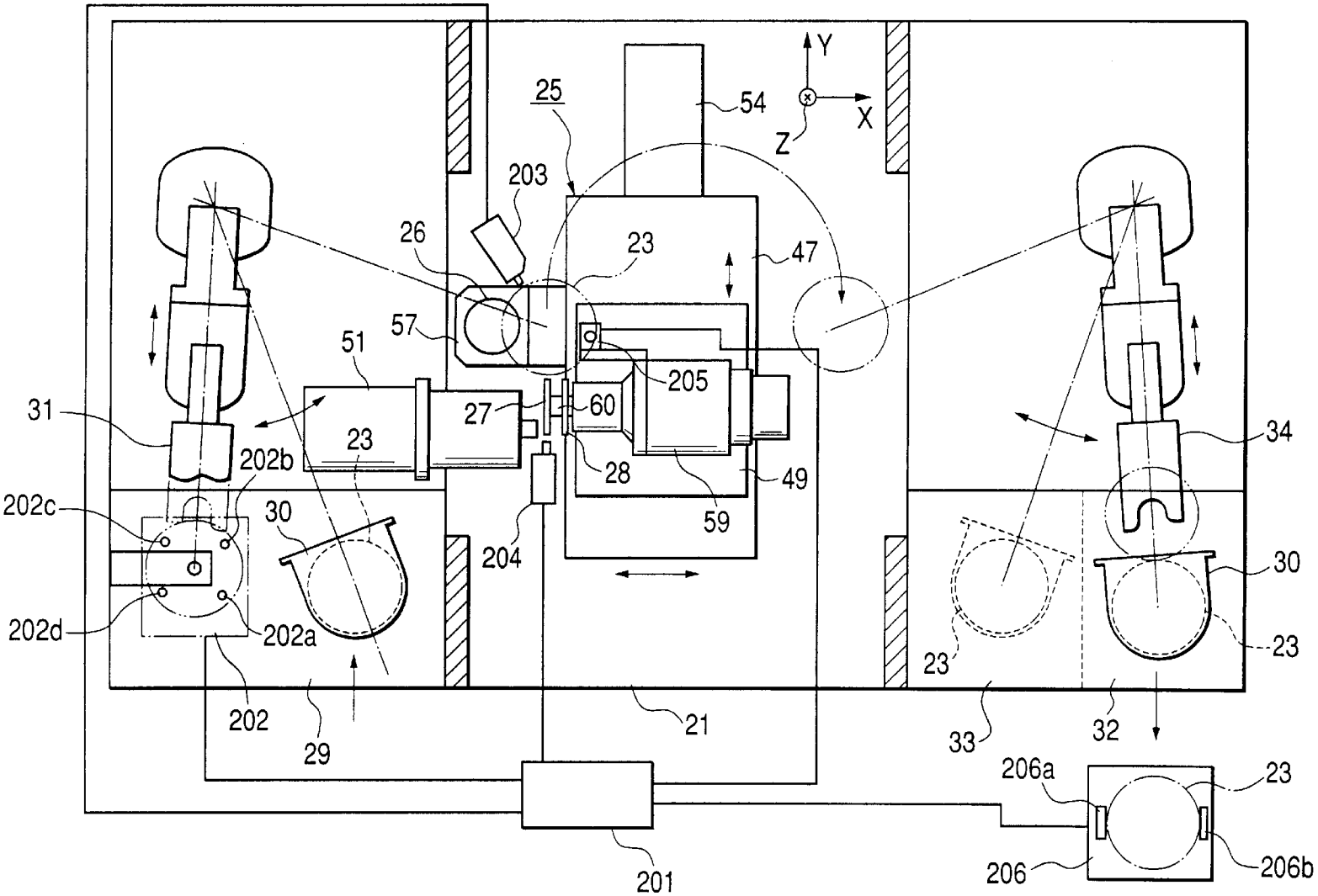
FIG. 1 is a partially fragmentary plan view illustrating an embodiment of a grinding apparatus.
Figure 2:
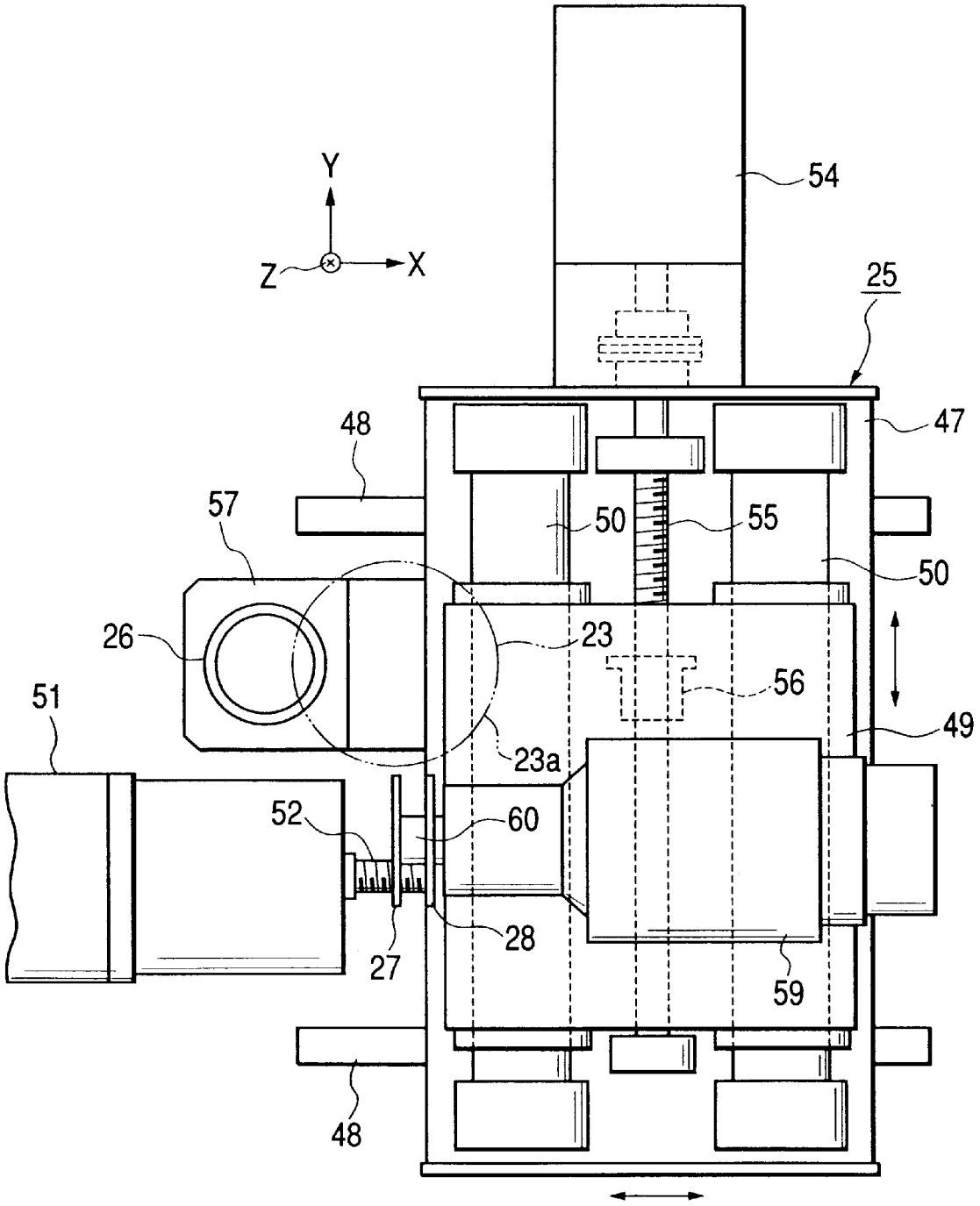
FIG. 2 is an enlarged plan view of an essential portion and illustrates in enlarged for a portion of the grinding apparatus shown in FIG. 1.
Figure 3:
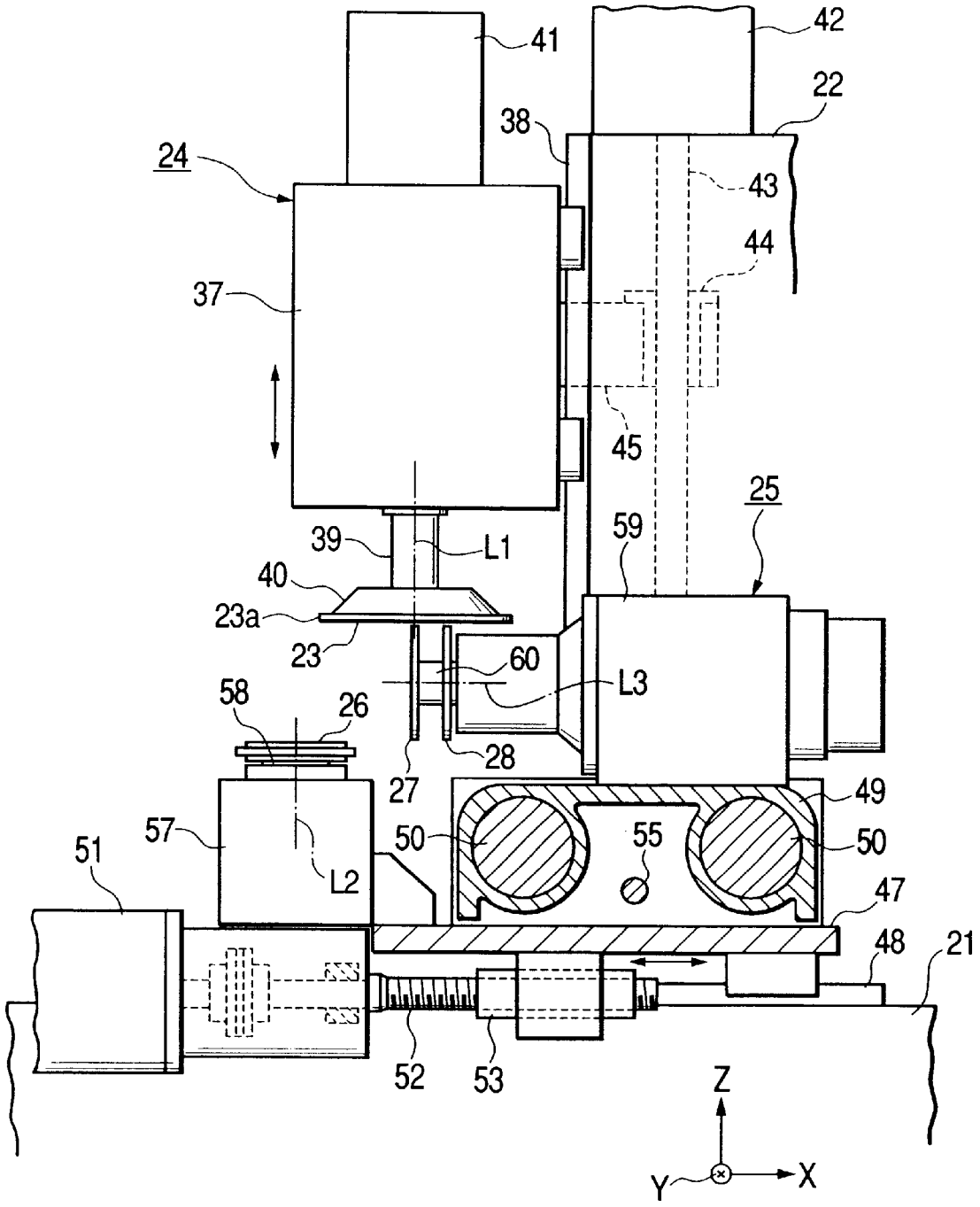
FIG. 3 is an enlarged cross-sectional view of the essential portion of the grinding apparatus shown in FIG. 1.

As shown in FIGS. 1 to 3, a column 22 is provided uprightly on a bed 21 of the grinding apparatus, and a workpiece holding mechanism 24 serving as a workpiece holding means for holding a workpiece 23 formed of a circular thin plate such as a semiconductor wafer is disposed on the column 22. A grinding mechanism 25 serving as a grinding means is disposed on the bed 21 in correspondence with the workpiece holding mechanism 24. This grinding mechanism 25 is provided with a rotating grinding wheel 26 for cylindrical grinding for the rough cutting of an outer peripheral edge portion 23*a* of the workpiece 23 as well as two disk-shaped rotating grinding wheels 27 and 28 for the rough grinding and finish grinding of the outer peripheral edge portion 23*a* of the workpiece 23.

It should be noted that, in this embodiment, a rotating grinding wheel which is formed by binding the grains of silicon dioxide ($SiO_2$) with a bond to form the silicon dioxide into fixed abrasive grains is used as the aforementioned rotating grinding wheel 28 for finishing.

On the left side of the grinding mechanism 25, a carrying-in station 29 is disposed on the bed 21, and a cassette 30 accommodating a plurality of u,machined workpieces 23 is carried into this carrying-in station 29. A first working robot 31 is installed in the rear of the carrying-in station 29, and the unmachined workpieces 23 are fetched one by one from the cassette 30 by the first working robot 31, and are delivered to the workpiece holding mechanism 24.

As shown in FIG. 1, a thickness measuring sensor 202 of a contact type for measuring the thickness of the workpiece 23 is disposed above the carrying-in station 29. By using four sensor elements 202*a*, 202*b*, 202*c*, and 202*d*, the thickness measuring sensor 202 measures the thickness of an outer periphery of one workpiece 23 at a time, and detects defective workpieces. Further, on the basis of the measured thickness, a controller 201 computes the center in the thicknesswise direction of the workpiece 23, and determines a reference position for feeding the workpiece 23 in a Z direction.

On the right side of the grinding mechanism 25, a carrying-out station 32 is disposed on the bed 21, and a cleaning mechanism 33 is provided in its lower portion. A second working robot 34 is installed in the rear of the carrying-out station 32, and the machined workpieces 23 are received by the second working robot 34 from the workpiece holding mechanism 24 and, after going through the cleaning mechanism 33, are accommodated in the cassette 30 on the carrying-out station 32.

An outside-diameter measuring sensor 206 is disposed above the carrying-out station 32. It should be noted that, in FIG. 1, the outside-diameter measuring sensor 206 is illustrated not above the carrying-out station 32, but in a different position for the sake of description. The outside-diameter measuring sensor 206 measures the outside diameter of the workpiece 23 by causing an abutting plate 206*a* and a pushing plate 206*b* provided with a sensor element to come into contact with the workpiece, the abutting plate 206*a* and the pushing plate 206*b* being respectively provided at two points located in correspondence with the diameter of the workpiece. On the basis of the measured outside diameter, the controller 201 confirms the finish of the workpiece 23.

Next, a detailed description will be given of the details of the arrangement of the workpiece holding mechanism 24. As shown in FIG. 3, a work head 37 is supported on a side surface of the column 22 in such a manner as to be movable in the Z-axis direction (in the vertical direction) through a guide rail 38 via rolling bearings. A rotating shaft 39 is supported on the work head 37 in such a manner as to be rotatable about the axis L1 extending in the Z-axis direction, and a suction pad 40 for sucking and holding the workpiece 23 is provided at a lower end thereof.

A workpiece rotating motor 41 is disposed on top of the work head 37, and the rotating shaft 39 is rotated by the motor 41, which in turn causes the workpiece 23 sucked and held onto the suction pad 40 to rotate about its center as the axis L1. A Z-axis moving motor 42 is disposed on top of the column 22, and a ball screw 43 is rotated by the motor 42, which in turn causes the work head 37 to move in the Z-axis direction through a connecting arm 45 attached to a nut 44.

Next, a description will be given of the details of the arrangement of the grinding mechanism 25. As shown in FIGS. 2 and 3, a supporting table 47 is disposed on the bed 21 in such a manner as to be movable in the X-axis direction (in a longitudinal direction) along a pair of guide rails 48 via rolling bearings. A saddle 49 is supported on the supporting table 47 in such a manner as to be movable in the Y-axis direction (in a transverse direction) along a pair of guide rods 50 via rolling bearings.

An X-axis moving motor 51 is disposed on the bed 21, and a ball screw 52 is rotated by the motor 51, which in turn causes the supporting table 47 to move in the X-axis direction through a nut 53. A Y-axis moving motor 54 is disposed in the rear of the supporting table 47, and a ball screw 55 is rotated by the motor 54 to move the saddle 49 in the Y-axis direction through a nut 56. The X-axis moving motor 51, the Y-axis moving motor 54, and the Z-axis moving motor 42 are subjected to numerical control, and permit automatic control on the basis of an NC program.

A first-grinding-wheel rotating motor 57 is disposed on top of the supporting table 47 on the left-hand side thereof, and the aforementioned rotating grinding wheel 26 for cylindrical grinding is mounted on a motor shaft 58 projecting from its upper surface. This rotating grinding wheel 26 for cylindrical grinding is rotated about the axis L2 parallel to the central axis L1 of the workpiece 23 by the first-grinding-wheel rotating motor 57.

A second-grinding-wheel rotating motor 59 is disposed on the saddle 49, and the aforementioned disk-shaped rotating grinding wheel 27 for rough grinding and rotating grinding wheel 28 for finish grinding are mounted on a motor shaft 60 projecting on a left side surface of the second-grinding-wheel rotating motor 59 at a predetermined interval therebetween. The rotating grinding wheel 27 for rough grinding and the rotating grinding wheel 28 for finish grinding are rotated about an axis L3 parallel to the plane of the workpiece 23 by the second-grinding-wheel rotating motor 59.

The grinding mechanism 25 is provided with a workpiece-outside-diameter measuring sensor 203 of a contact type for measuring the outside diameter of the workpiece 23 after the rough cutting process, a grinding-wheel-diameter measuring sensor 204 for measuring the diameters of the rotating grinding wheel 27 for rough grinding and the rotating grinding wheel 28 for finish grinding, and a Z-direction position measuring sensor 205 for detecting the position of the workpiece 23 in the Z direction.

The workpiece-outside-diameter measuring sensor 203 is disposed in the vicinity of the first-rotating-wheel rotating motor 57 so as to measure the outside diameter of the workpiece 23 after the rough cutting process. On the basis of the measured outside diameter of the workpiece 23, the controller 201 detects the amount of wear of the rotating grinding wheel 26 for cylindrical grinding. The controller.201 adjusts the amount of feed of the grinding wheel 26 in the x direction so that the depth of cut into the workpiece 23 becomes constant in the rough cutting process. In addition, if the workpiece 23 is not ground by a predetermined amount, the controller 201 determines that the wear of the grinding wheel 26 is large, and warns the operator to replace the grinding wheel 26. Further, a mounting base for mounting the sensor 203 as well as the workpiece holding mechanism 24 including the rotating shaft 39, the suction pad 40, and the like expand due to heat generated during the grinding process, exerting adverse effects on the measurement. For this reason, to compensate for their displacements caused by the thermal expansion, zero adjustment is performed for adjusting the relative positions of the sensor 203 and the suction pad 40. This zero adjustment is effected by causing the sensor 203 to abut against an outer peripheral edge portion of the suction pad 40.

The grinding-wheel-diameter measuring sensor 204 is disposed radially outwardly of the rotating grinding wheel 27 for rough grinding or the rotating grinding wheel 28 for finish grinding so as to measure the outside diameters of the grinding wheels 27 and 28. The controller 201 detects the amounts of wear of the grinding wheels 27 and 28 from the measured outside diameters of the grinding wheels 27 and 28, and adjusts the amount of feed of the grinding wheels 27 and 28 in the Y direction and the amount of feed of the workpiece 23 in the Z direction. Further, if it is determined that the amounts of wear of the grinding wheels 27 and 28 are large, the controller 201 warns the operator to replace the grinding wheels 27 and 28. In the case of the grinding-wheel-diameter measuring sensor 204 as well, to compensate for displacements due to the thermal expansion of a mounting base for mounting the sensor 204, the motor shaft 60 for mounting the grinding wheels 27 and 28, and the like, zero adjustment is performed for adjusting the relative positions of the sensor 204 and the grinding wheels 27 and 28. This zero adjustment is effected by causing the sensor 204 to abut against a block provided on a bearing housing of the motor shaft 60 for mounting the grinding wheels 27 and 28.

The Z-direction position measuring sensor 205 is disposed on the housing side of the motor 59 so as to face the lower surface of the suction pad 40, and measures the Z-direction position of the suction pad 40 at its reference position in a non-contact manner as the Z-direction position measuring sensor 205 is positioned in such a manner as to oppose the lower surface of the suction pad 40 in a state in which the workpiece 23 is not fitted to the suction pad 40. On the basis of the Z-direction position of the workpiece 23, the controller 201 detects the elongation in the Z direction of the workpiece holding mechanism 24 including the rotating shaft 39, the suction pad 40, and the like due to their thermal expansion, and adjusts the reference position for feeding the workpiece 23 in the Z direction.

In addition, to maintain the relative positional relationship in the Y direction between the workpiece 23 and the grinding wheels 27 and 28 constant, a Y-direction position measuring sensor may be provided radially outwardly of the suction pad 40 so as to compensate for the relative displacements due to the thermal expansion of the Y-direction feeding mechanism for the grinding wheels 27 and 28 and the workpiece holding mechanism 24. In this case, the Y-direction position at the Y-direction reference position is measured in a non-contact manner with respect to a reference point provided on the saddle 49 or the housing of the motor 59. Alternatively, the Y-direction position measuring sensor may be disposed on a side of the saddle 49 or the housing of the motor 59. On the basis of the Y-direction position of the workpiece 23, the controller 201 detects the elongation in the Y-direction of the Y-direction feeding mechanism and the workpiece holding mechanism 24 due to their thermal expansion, and adjusts the reference position for feeding the workpiece 23 in the Y direction.

Next, a description will be given of the method of grinding in the case where the outer peripheral edge 23*a* of the workpiece 23 is ground by using the grinding apparatus having the above-described construction.

Figure 4A:
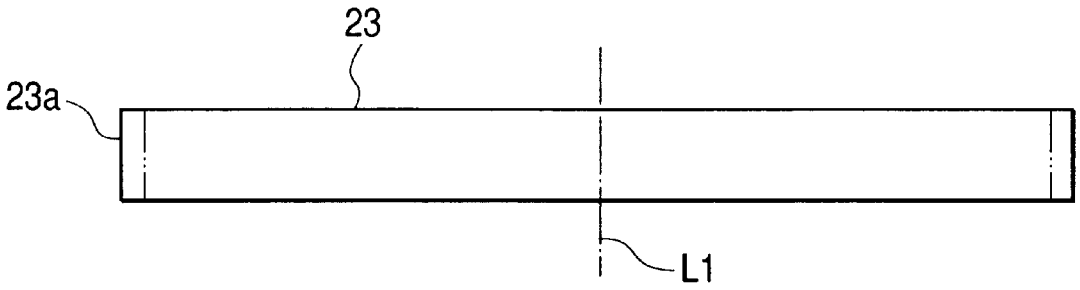
FIGS. 4A to 4C are explanatory views illustrating the method of grinding an outer peripheral edge portion in the order of processes.
Figure 4B:
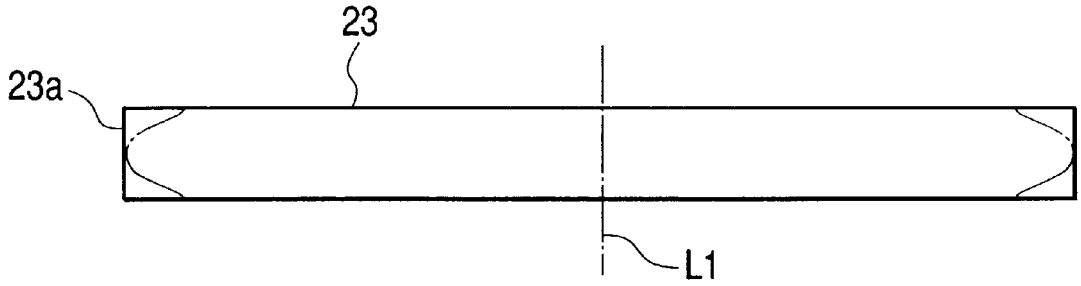
Figure 4C:
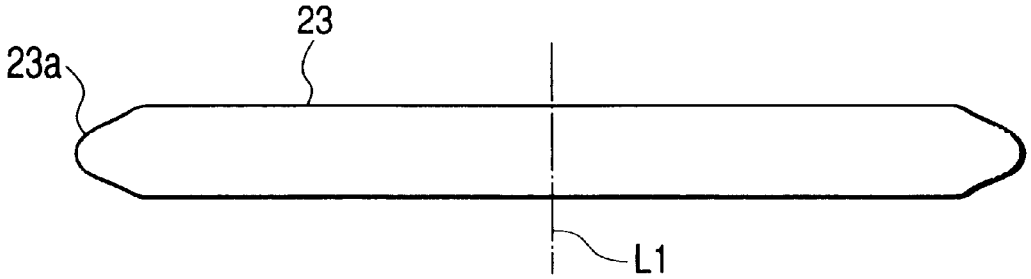

In the method of grinding a workpiece, as shown in FIGS. 4A to 4C, the outer peripheral edge 23*a* of the workpiece 23 is ground separately in three processes. Namely, first, the outer peripheral edge portion 23*a* of the workpiece 23 is subjected to rough cutting by the rotating grinding wheel 26 for cylindrical grinding, as shown in FIG. 4A. Next, as shown in FIG. 4B, the outer peripheral edge portion 23*a* after its rough cutting is subjected to rough grinding by the disk-shaped rotating grinding wheel 27 for rough grinding. Subsequently, the outer peripheral edge portion after its rough grinding is subjected to finish grinding by the rotating grinding wheel 28 for finish grinding, as shown in FIG. 4C.

Figure 5A:
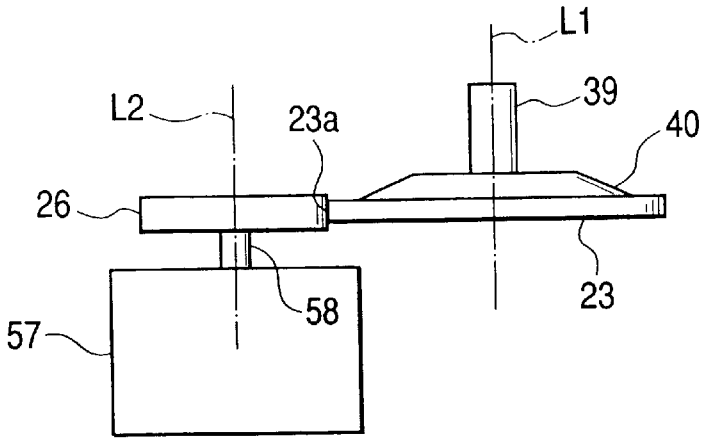
FIGS. 5A and 5B are a front elevational view and a plan view illustrating a rough cutting process.
Figure 5B:
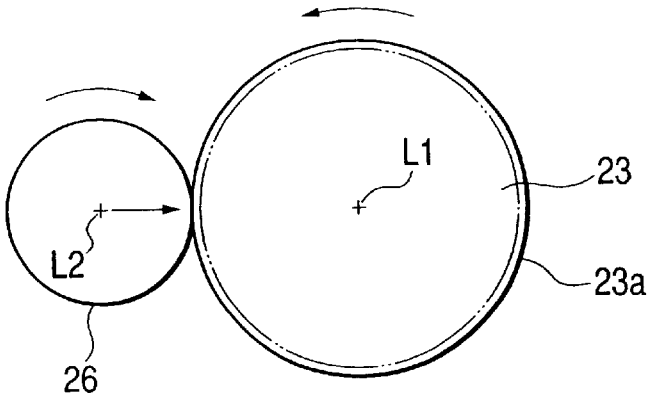

Accordingly, a detailed description will be given of the rough cutting process. As shown in FIGS. 5A and 5B, the workpiece 23 is moved and disposed at a heightwise position corresponding to the rotating grinding wheel 26 for cylindrical grinding by the Z-axis moving motor 42 in a state in which the workpiece 23 is being sucked and held onto the suction pad 40 of the workpiece holding mechanism 24. In this state, the workpiece 23 is rotated about the axis L1 by the workpiece rotating motor 41, and the rotating grinding wheel 26 for cylindrical grinding is rotated about the axis L2 parallel to the central axis L1 of the workpiece 23 by the first-rotating-wheel rotating motor 57. At the same time, the rotating grinding wheel 26 for cylindrical grinding is moved to be fed toward the outer peripheral edge portion 23*a* of the workpiece 23 by the X-axis moving motor 51. Consequently, the outer peripheral edge portion 23*a* of the workpiece 23 is subjected to rough cutting by cylindrical grinding, as shown by the chain lines in FIGS. 4A and 5B.

Figure 5C:
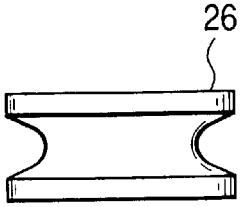
FIG. 5*c* is a side view illustrating a modification of a rotating grinding wheel for the rough cutting process.

In the rough cutting process, a forming grinding wheel as shown in FIG. 5C can be used as the rotating grinding wheel 26 for cylindrical grinding so as to reduce the grinding amount in the following rough grinding process.

Figure 6A:
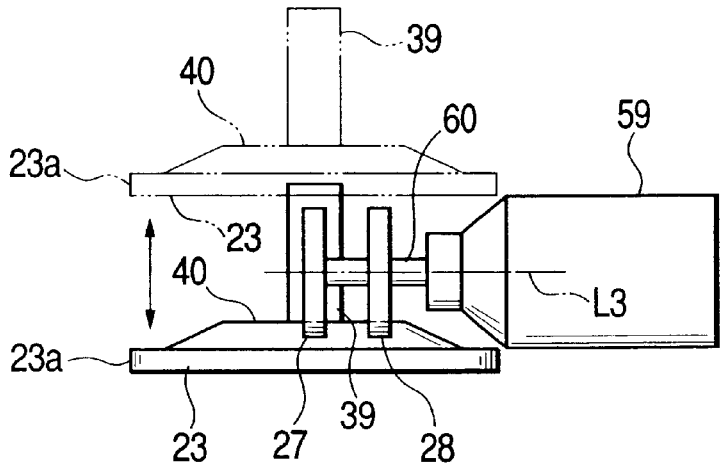
FIGS. 6A an 6B are a front elevational view and a plan view illustrating a rough grinding process.
Figure 6B:
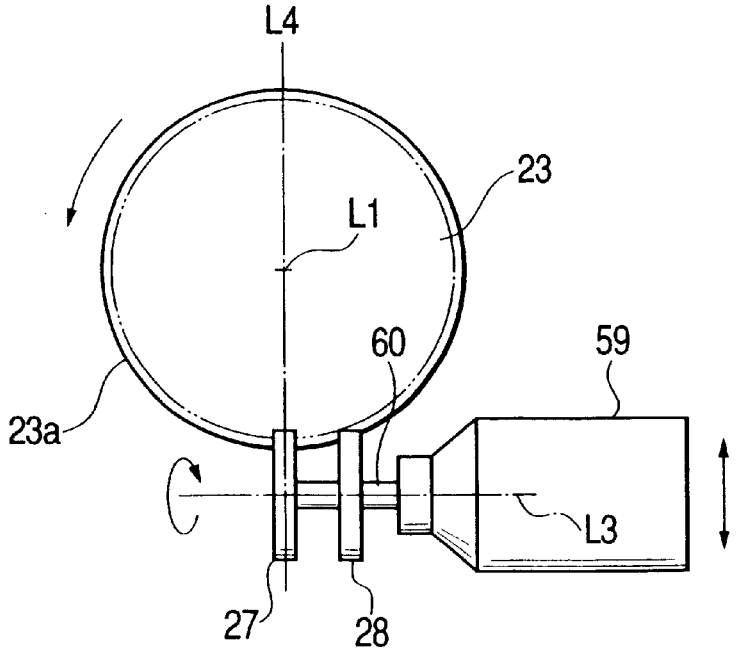

Subsequently, in the rough grinding process, as shown in FIGS. 6A and 6B, the rotating grinding wheel 27 for rough grinding is moved and disposed by the X-axis moving motor 51 at a position corresponding to a line L4 passing through the axis L1 of the workpiece 23 in the X direction while the workpiece 23 is sucked and held onto the suction pad 40. In this state, the workpiece 23 is rotated by the workpiece rotating motor 41, and the rotating grinding wheel 27 for rough grinding is rotated about the axis L3 extending in a direction parallel to the plane of the workpiece 23 and perpendicular to the radial direction of the workpiece 23 by the second-rotating-wheel rotating motor 59.

Figure 7:
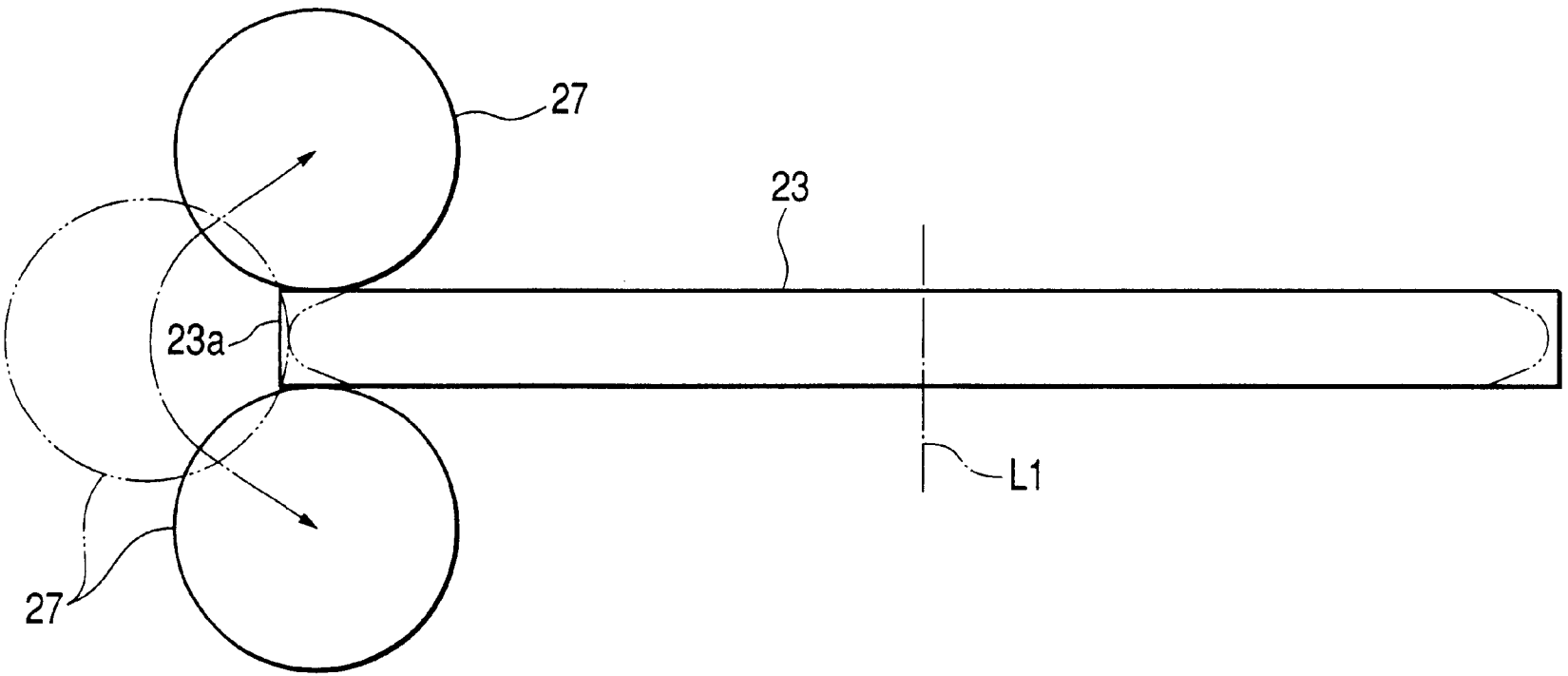
FIG. 7 is a side elevational view illustrating in enlarged form the rough grinding process shown in FIGS. 6A and 6B.

At the same time, the workpiece 23 is moved in the Z-axis direction by the Z-axis moving motor 42 on the basis of a predetermined NC program, and the rotating grinding wheel 27 for rough grinding is moved in the Y-axis direction by the Y-axis moving motor 54. Through this simultaneous two-axes control, the rotating grinding wheel 27 is moved to be fed with respect to the workpiece 23 in such a manner as to depict a predetermined locus of movement between the obverse and reverse surfaces of the workpiece 23 along the outer peripheral edge portion 23*a* of the workpiece 23, as shown in FIG. 7. Consequently, as shown by the chain lines in FIGS. 4B, 6B, and 7, the outer peripheral edge portion 23*a* of the workpiece 23 is subjected to rough grinding by the outer peripheral wheel surface of the rotating grinding wheel 27 in the same station as that for the above-described rough cutting process in such a manner as to form a tapered profile with an arcuate peripheral edge portion in its cross section.

Figure 8A:
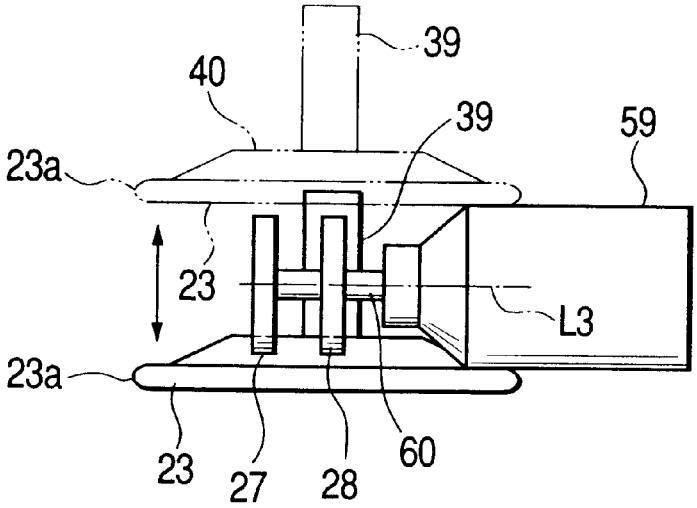
FIGS. 8A and 8B are a front elevational view and a plan view illustrating a finish grinding process.
Figure 8B:
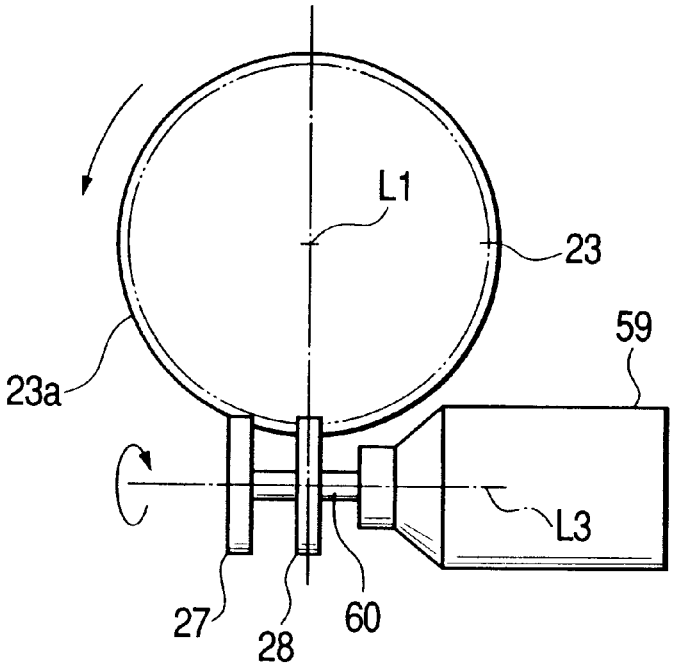

Further, in the finish grinding process, as shown in FIGS. 8A and 8B, the rotating grinding wheel 28 for finish grinding is moved and disposed by the X-axis moving motor 51 at a position corresponding to the line L4 in the X-direction while the workpiece 23 is sucked and held onto the suction pad 40. In this state, the workpiece 23 is rotated by the workpiece rotating motor 41, and the rotating grinding wheel 28 for finish grinding is rotated about the axis L3 by the second-grinding-wheel rotating motor 59.

Figure 9A:
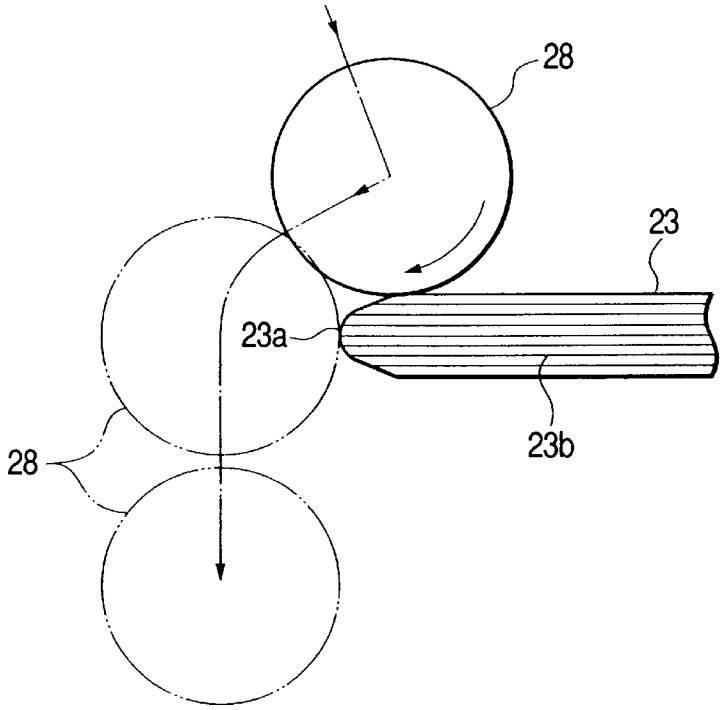
FIGS. 9A And 9B are partial side elevational views illustrating in enlarged form the finish grinding process shown in FIGS. 8A and 8B.
Figure 9B:
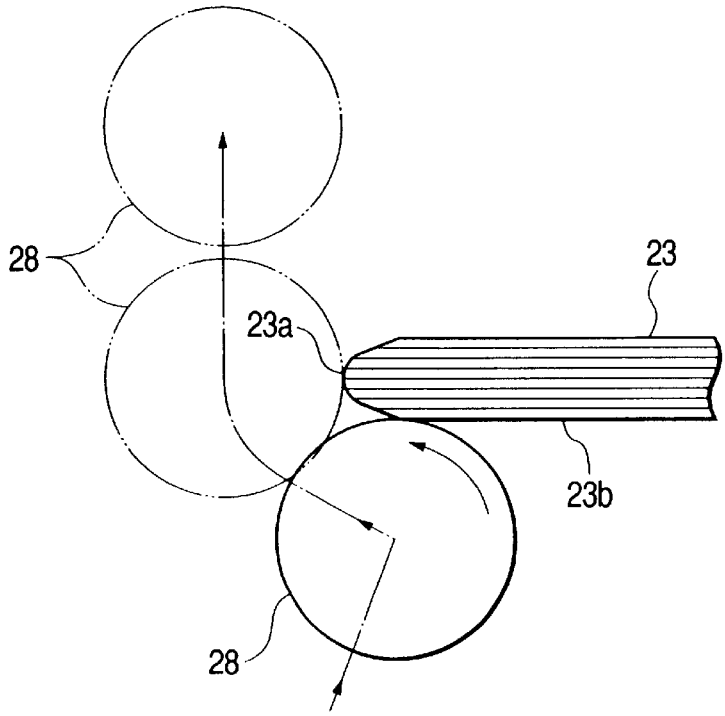

At the same time, the workpiece 23 is moved in the Z-axis direction by the Z-axis moving motor 42 on the basis of the predetermined NC program, and the rotating grinding wheel 28 for finish grinding is moved in the Y-axis direction by the Y-axis moving motor 54. Through this simultaneous two-axes control, the rotating grinding wheel 28 is moved to be fed with respect to the workpiece 23 in such a manner as to depict a predetermined locus of movement between the obverse and reverse surfaces of the workpiece 23 along the outer peripheral edge portion 23*a* of the workpiece 23, as shown in FIGS. 9A and 9B. Consequently, as shown by the chain lines in FIGS. 4C, 8B, 9A, and 9B, the outer peripheral edge portion 23*a* of the workpiece 23 is subjected to finish grinding into a desired profile by the outer peripheral wheel surface of the rotating grinding wheel 28 in the same station as that for the above-described rough cutting process and rough grinding process.

In this case, as shown in FIGS. 9A and 9B, crystal orientation 23*b* extends in the workpiece 23 substantially in parallel with the obverse and reverse surfaces of the workpiece 23, and different angles of the crystal face appear in the outer peripheral edge portion 23*a* of the workpiece 23 from both obverse and reverse surface sides to the tip of the edge portion. For this reason, it is necessary to effect grinding by changing the grinding conditions (the feeding speed in grinding movement, the rotating speeds of the workpiece 23 and the grinding wheel 28, etc.) in accordance with the angles of the crystal face. By adopting a grinding method in which a machining step over the obverse and reverse surfaces is bisected as shown in FIGS. 9A and 9B, and the feed-moving direction of the rotating grinding wheel 28 for finish grinding and the rotating direction of the rotating grinding wheel 28 are changed with respect to the outer peripheral edge portion 23*a* of the workpiece 23 so as to depict mutually symmetrical loci of movement, it becomes possible to effect grinding by the same change of the grinding conditions for both the obverse and reverse surface sides, and it is possible to prevent the occurrence of variations in the roughness of the ground surface between the obverse surface side and the reverse surface side of the edge portion.

Specifically, the outer peripheral edge portion 23*a* of the workpiece 23 is not ground continuously between the obverse and reverse surfaces sides thereof, and finish grinding is effected separately for the obverse surface side and the reverse surface side. Namely, as shown in FIG. 9A, first, the rotating grinding wheel 28 for finish grinding, while being rotated in one direction, is moved to be fed toward the outer peripheral edge portion 23*a* of the workpiece 23 starting with its obverse surface side and then toward its tip side, thereby subjecting the obverse surface side of the outer peripheral edge portion 23*a* to finish grinding. Subsequently, as shown in FIG. 9B, the rotating grinding wheel 28, while being rotated in the opposite direction, is moved to be fed toward the outer peripheral edge portion 23*a* of the workpiece 23 starting with its reverse surface side and then toward its tip side, thereby subjecting the reverse surface side of the outer peripheral edge portion 23*a* to finish grinding.

Further, after the outer peripheral edge portion 23*a* of the workpiece 23 is subjected to finish grinding as described above, the workpieces 23 in a state of being accommodated in the cassette 30 are transported from the grinding apparatus to another station. In this other station, the final finishing of the outer peripheral edge portion 23*a* of the workpiece 23 is effected by using an unillustrated disk-shaped polishing pad and slurry. Namely, an outer peripheral surface of the disk-shaped polishing pad is caused to abut against the outer peripheral surface of the workpiece 23 in the same way as the rotating grinding wheels 27 and 28. At the same time, slurry which is prepared by mixing abrasive grains into a dispersant is supplied to a gap between the polishing pad and the workpiece 23. By so doing, the edge portion 23*a* of the workpiece 23 is subjected to super-finish grinding by the grains in the slurry.

(Modifications)

It should be noted that this embodiment may be embodied by making the following modifications.

(a) In the grinding apparatus of the above-described embodiment, the work head 37 and the saddle 49 are respectively movably supported to the guide cylinder 140 and the guide rod 50 by means of hydrostatic bearings 142, 146 and 180.

Figure 10:
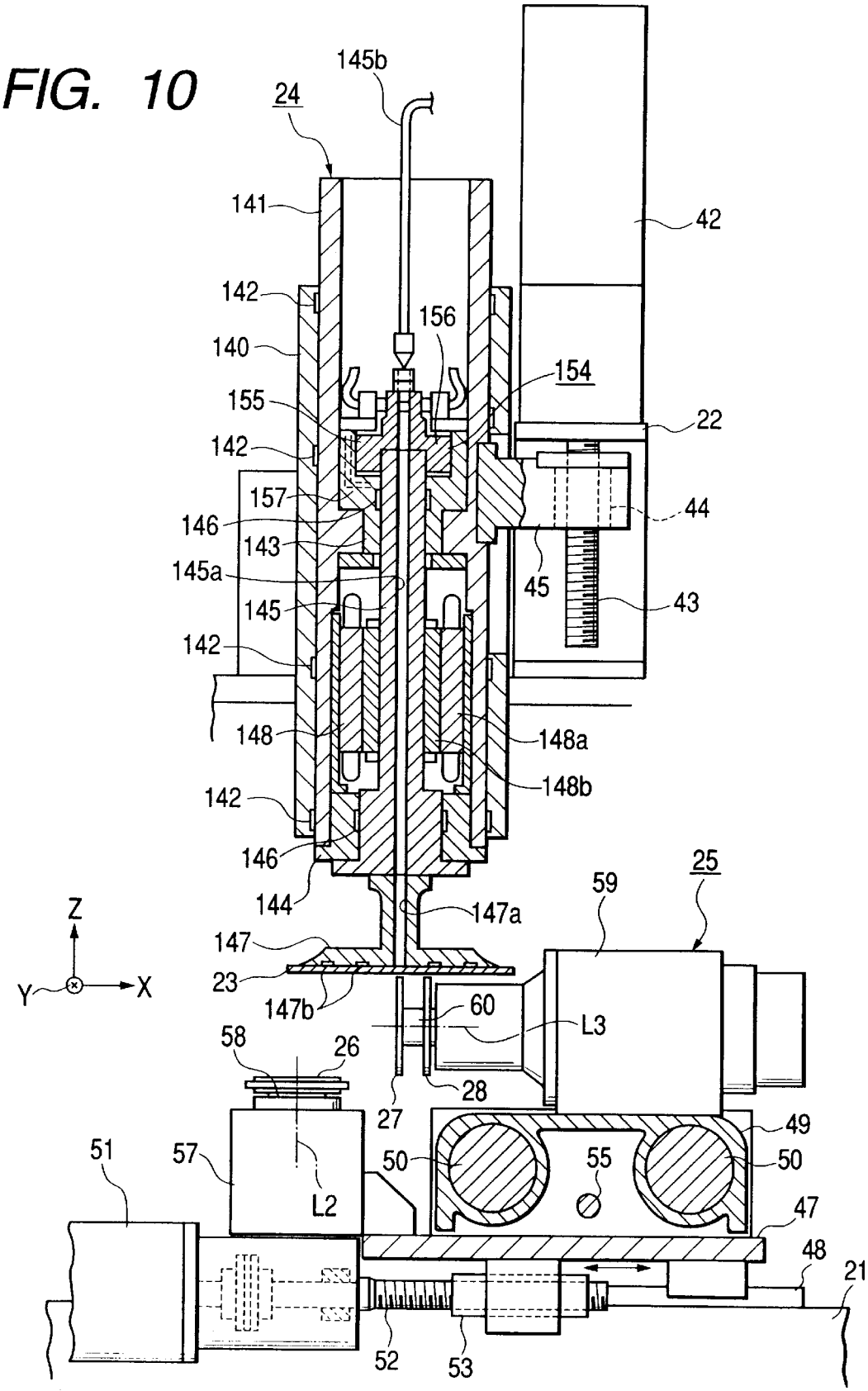
FIG. 10 is an enlarged cross-sectional view of a modification of a workpiece holding mechanism of the grinding apparatus shown in FIG. 1.
Figure 11:
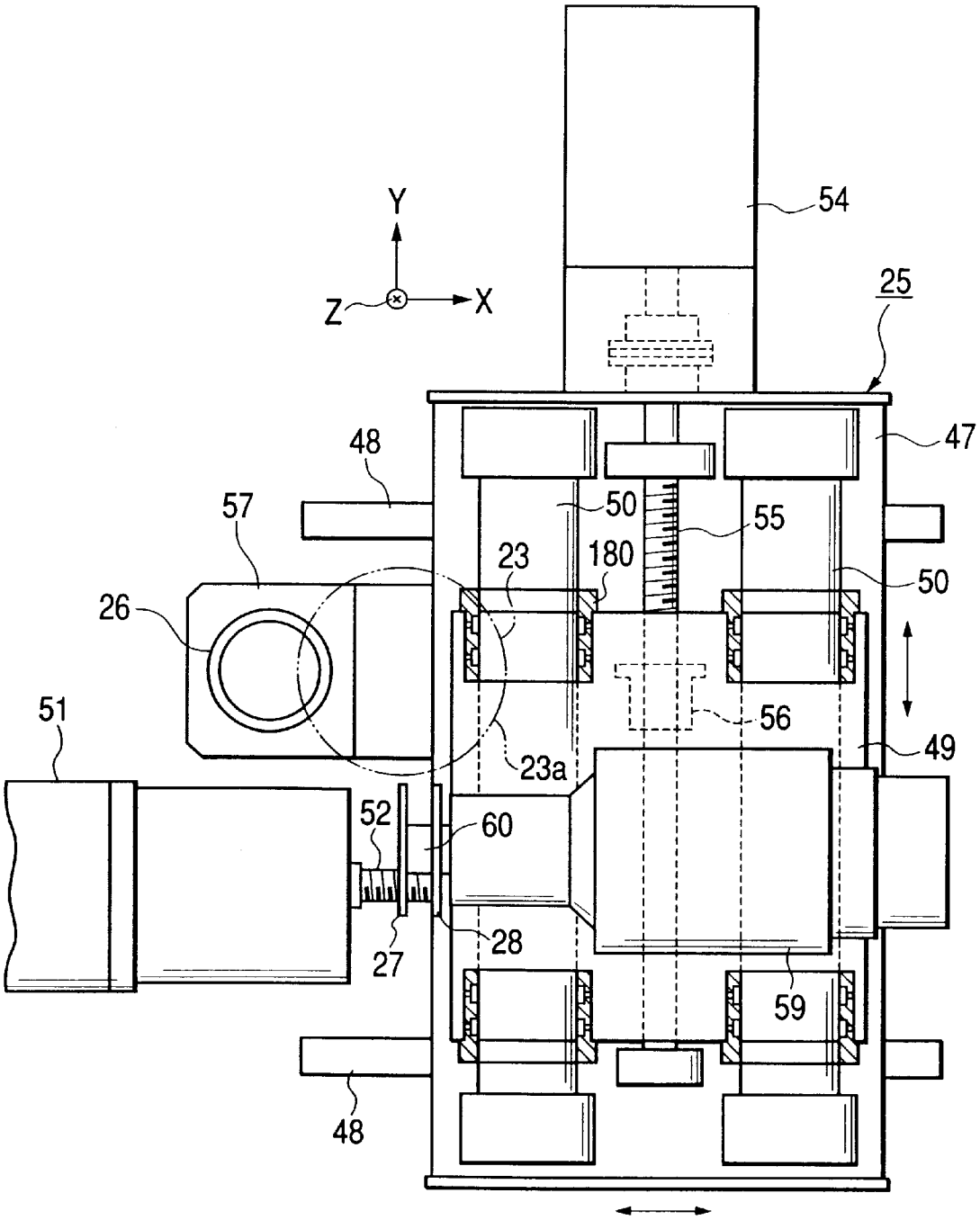
FIG. 11 is an enlarged plan view of a modification of a grinding mechanism of the grinding apparatus shown in FIG. 1.

A description will be given of the work holding mechanism 24 including the hydrostatic bearings in detail. As shown in FIG. 10, the guide cylinder 140 is attached to a side of the column 22 in such a manner as to extend in the vertical direction (in the Z direction). A supporting cylinder 141 is supported in the guide cylinder 140 by means of hydrostatic bearings 142 in such a manner as to be movable in the Z direction, and a pair of bearing cylinders 143 and 144 are disposed in the supporting cylinder 141. A supporting shaft 145 is supported in the bearing cylinders 143 and 144 by means of hydrostatic bearings 146 in such a manner as to be rotatable and liftable. An air passage 145*a* is formed in its center, and the air passage 145*a* is connected to a vacuum pump (not shown) through a hose 145*b*.

A suction pad 147 is fixed to a lower end of the supporting shaft 145 by means of bolts (not shown). In the center of the suction pad 147, there is formed an air passage 147*a* communicating with the air passage 145*a* of the supporting shaft 145. Further, in the lower surface thereof, there is formed a plurality of suction grooves 147*b* communicating with the air passage 147*a*. A motor 148 for rotation is disposed within the supporting cylinder 141, a stator 148*a* thereof is fixed to the supporting cylinder 141, and a rotor 148*b* thereof is fixed to the supporting shaft 145. The suction pad 147 is rotated by the motor 148 for rotation via the supporting shaft 145.

A motor 42 for movement is disposed above the column 22, and a ball screw 43 is projectingly provided on a lower portion of the motor 42. A connecting arm 45 is projectingly provided on an outer periphery of the supporting cylinder 141, and a nut 44 meshing with the ball screw 43 is attached to a distal end of the connecting arm 45. As the ball screw 43 is rotated by the motor 42 for movement, the supporting cylinder 141 is moved vertically by means of the nut 44, thereby moving the suction pad 147 vertically.

For this reason, when the workpiece 23 is moved at least in the Z direction, the relative movement of the disk-shaped rotating grinding wheels 27 and 28 and the workpiece 23 is effected smoothly by the guide mechanism including the hydrostatic bearings 142 and 146. Accordingly, compared with a guide mechanism including rolling bearings, it is possible to prevent the vibrations from occurring during the relative movement of the disk-shaped rotating grinding wheels 27 and 28 and the workpiece 23, thereby making it possible to improve the processing accuracy of the ground surface of the workpiece 23.

The guide mechanism including the hydrostatic bearings 180 is also provided in the arrangement for moving the grinding mechanism 25 in the Y direction. For this reason, when the rotating grinding wheels 27 and 28 and the workpiece 23 are relatively moved in the Y direction within the plane including the rotational axis of the disk-shaped rotating grinding wheels 27 and 28, the relative movement of the rotating grinding wheels 27 and 28 and the workpiece 23 is effected smoothly by the guide mechanism including the hydrostatic bearings 180. Accordingly, it is possible to prevent the vibrations from occurring during the relative movement of the rotating grinding wheels 27 and 28 and the workpiece 23 in the Y direction as well, thereby making it possible to further improve the processing accuracy of the ground surface of the workpiece 23.

The hydrostatic bearings 146 are also provided in the mechanism for supporting the rotation of the workpiece 23. For this reason, the workpiece 23 is supported so as to rotate smoothly, thereby making it possible to further improve the processing accuracy of the ground surface of the workpiece 23.

Figure 12A:
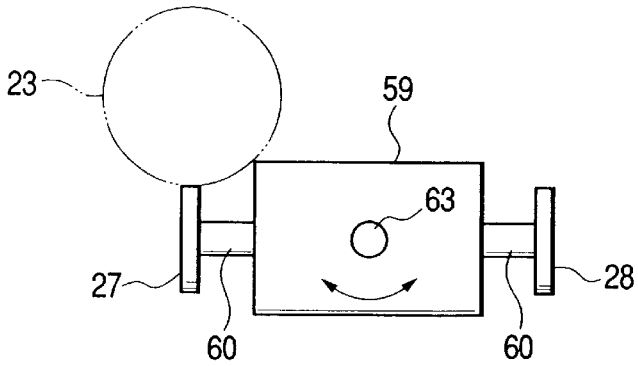
FIGS. 12A to 12C are plan views illustrating modifications of a grinding wheel head.

(b) In the grinding apparatus of the above-described embodiment, as shown in FIG. 12A, the second-grinding-wheel rotating motor 59 is supported on the saddle 49 by means of a supporting shaft 63 in such a manner as to be capable of undergoing indexed rotation, and the rotating grinding wheel 27 for rough grinding and the rotating grinding wheel 28 for finish grinding are respectively mounted on the motor shafts 60 projecting from left and right opposite side surfaces of the motor 59.

In this arrangement, since the second-grinding-wheel rotating motor 59 is made to undergo indexed rotation, either one of the rotating grinding wheel 27 for rough grinding and the rotating grinding wheel 28 for finish grinding is disposed at the position corresponding to the axis L1 of the workpiece 23. Then, in this state of corresponding displacement, the rough grinding and finish grinding of the outer peripheral edge portion 23*a* of the workpiece 23 can be performed consecutively by the same station.

Figure 12B:
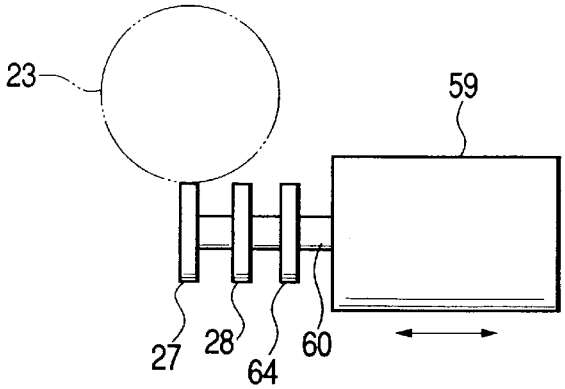

(c) In the grinding apparatus of the above-described embodiment, as shown in FIG. 12B, the disk-shaped rotating grinding wheel 27 for rough grinding and rotating grinding wheel 28 for finish grinding as well as a polishing pad 64 are mounted at predetermined intervals on the motor shaft 60 projecting from the left side surface of the second-rotating-wheel rotating motor 59.

If such an arrangement is provided, after the outer peripheral edge portion 23*a* of the workpiece 23 is subjected to rough grinding and finish grinding by using the rotating grinding wheel 27 for rough grinding and the rotating grinding wheel 28 for finish grinding, the final finishing of the outer peripheral edge portion 23*a* can be performed in the same station as that for these grinding operations by using the polishing pad 64 and slurry.

Figure 12C:
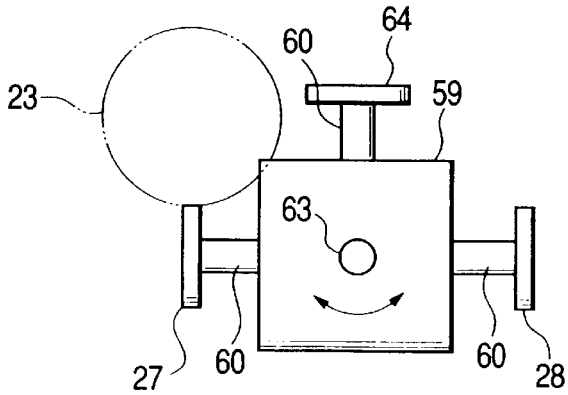

(d) In the grinding apparatus of the above-described embodiment, as shown in FIG. 12C, the second-rotating-wheel rotating motor 59 is supported on the saddle 49 by means of a supporting shaft 63 in such a manner as to be capable of undergoing indexed rotation, and the rotating grinding wheel 27 for rough grinding, the rotating grinding wheel 28 for finish grinding, and the polishing pad 64 are mounted on the motor shafts 60 projecting from the left and right opposite side surfaces and rear surface of the motor 59.

In this arrangement, since the second-rotating-wheel rotating motor 59 is made to undergo indexed rotation, any one of the rotating grinding wheel 27 for rough grinding, the rotating grinding wheel 28 for finish grinding, and the polishing pad 64 is disposed at the position corresponding to the axis L1 of the workpiece 23. Then, in this state of corresponding displacement, the rough grinding, finish grinding, and final finishing of the outer peripheral edge portion 23*a* of the workpiece 23 can be performed consecutively by the same station.

(e) In the grinding apparatus of the above-described embodiment, as the rotating grinding wheel 27 for rough grinding as well, it is possible to use a rotating grinding wheel which is formed by binding the grains of silicon dioxide into fixed abrasive grains in the same way as the rotating grinding wheel 28 for finish grinding.

(f) As the fixed abrasive grains of the rotating grinding wheel 28 for finish grinding, silicon carbide or the like which is generally used is employed.

(g) In the grinding apparatus of the above-described embodiment, the rough grinding of the outer peripheral edge portion 23*a* of the workpiece 23 by the rotating grinding wheel 27 for rough grinding is also performed separately for the obverse surface side and the reverse surface side of the outer peripheral edge portion 23*a* in the same way as finish grinding shown in FIGS. 9A and 9B.

(h) In the grinding apparatus of the above-described embodiment, a forming grinding wheel is used as the rotating grinding wheel 26 for rough cutting.

(i) A Z-axis direction moving mechanism is provided on the grinding wheel 27,28 side, and the outer peripheral edge portion 23*a* of the workpiece 23 is ground by the feed movement in the Z-axis direction and the Y-axis direction of the grinding wheel 27,28 side without moving the workpiece 23. Alternatively, the workpiece 23 side is movable in the X-axis direction and in the Y-axis direction, while the grinding wheel 27,28 side is made movable in the Z-axis direction.

Figure 13:
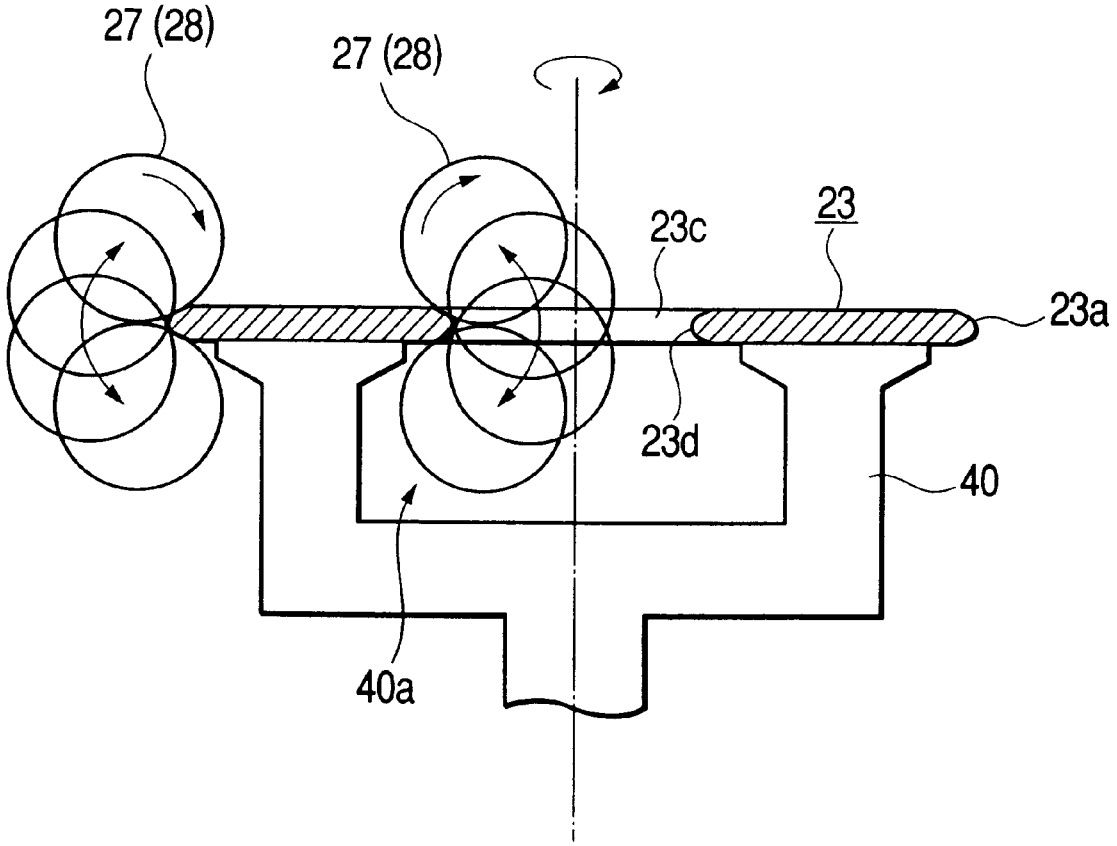
FIG. 13 is a cross-sectional view illustrating a modification of the grinding process.

(j) As shown in FIG. 13, a workpiece having a circular hole 23*c* in its center is used as the workpiece 23, a peripheral edge of the circular hole 23*c*, i.e., an inner peripheral edge portion 23*d*, is ground in addition to the outer peripheral edge portion 23*a*. Namely, the workpiece 23 is sucked onto the suction pad 40 having a space 40*a* in its central portion, a smaller rotating grinding wheel 27 for rough grinding or rotating grinding wheel 28 for finish grinding is relatively moved to be fed between the obverse and reverse surface sides of the workpiece 23 in the same way as the above-described grinding of the outer peripheral edge portion 23*a*, thereby making it possible to grind the inner peripheral edge portion 23*d*. In this case, it is possible to continuously perform the grinding of the outer peripheral edge portion 23*a* and the inner peripheral edge portion 23*d* of the workpiece 23 by using the same grinding wheel in the same machining station, so that the arrangement of the apparatus is made compact, and the machining shape accuracy can be improved.

Figure 14:
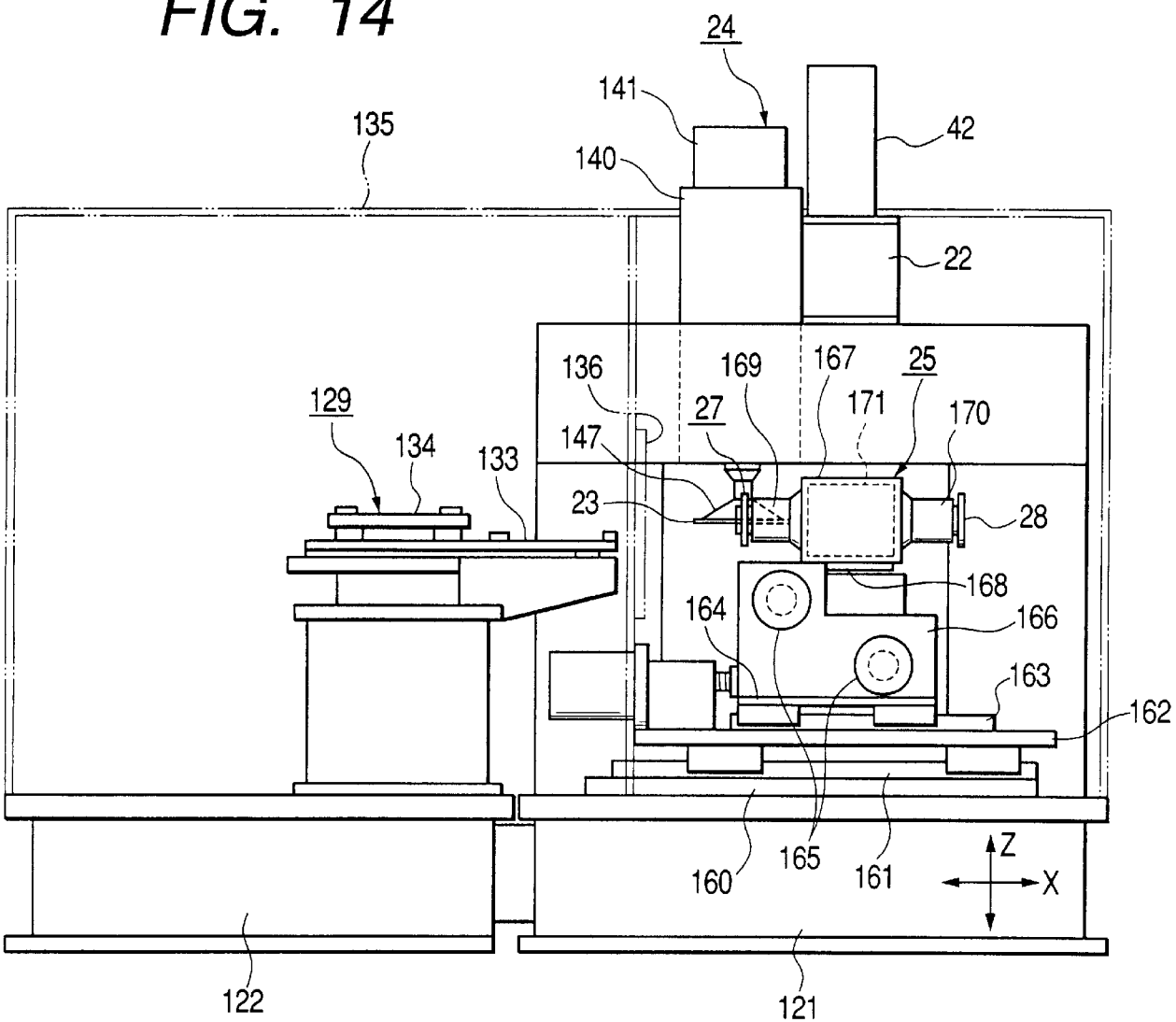
FIG. 14 is a front elevational view illustrating a modification of the grinding apparatus.
Figure 15:
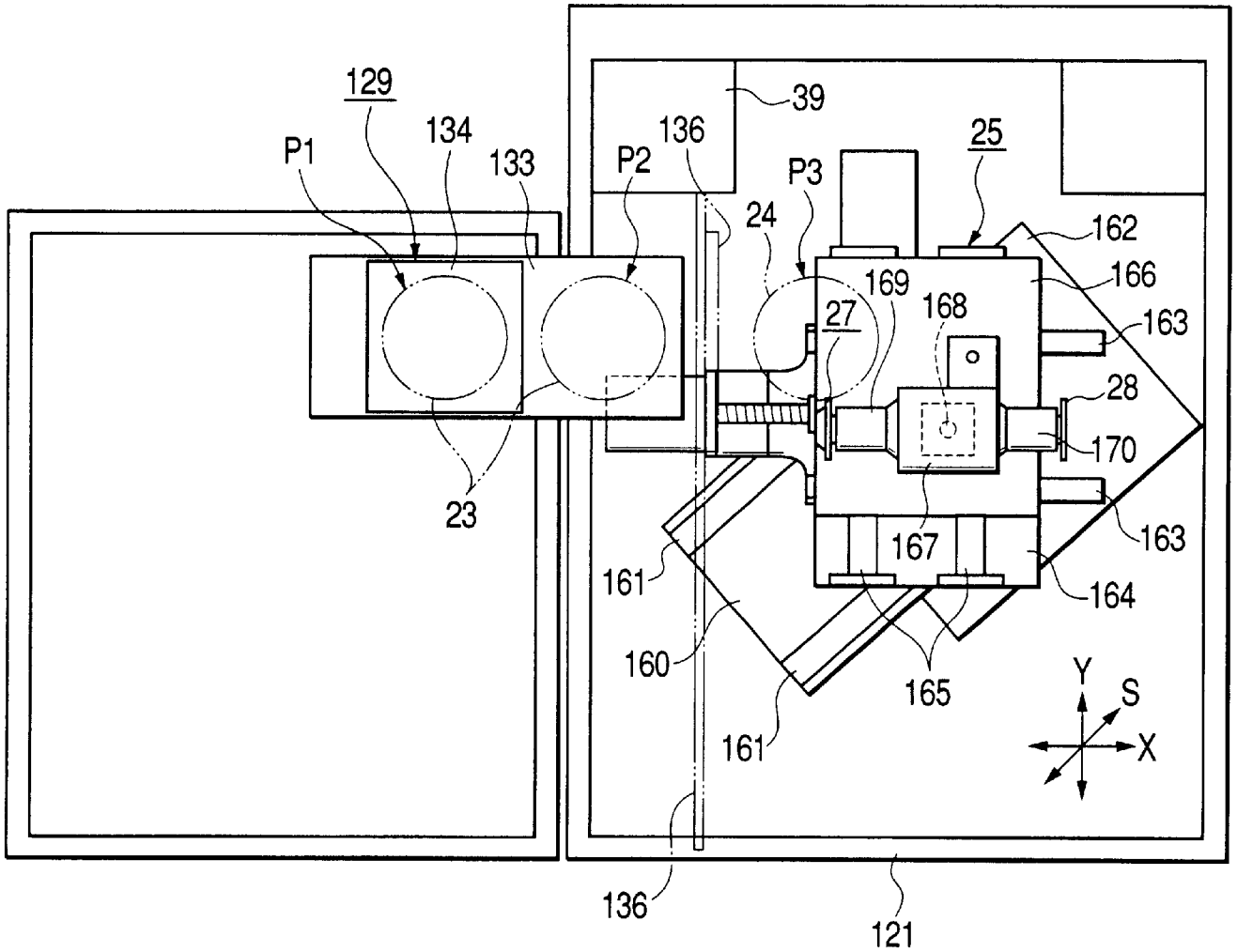
FIG. 15 is a plan view illustrating the modification of the grinding apparatus shown in FIG. 14.
Figure 16:
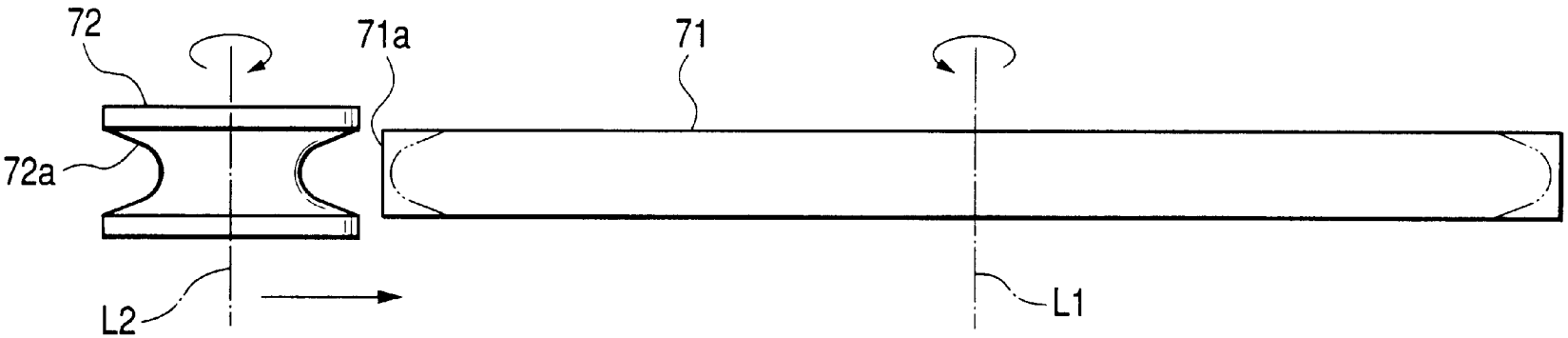
FIG. 16 is an explanatory diagram illustrating a conventional method of grinding a workpiece.

(k) In the grinding method of the above-described embodiment, the rough grinding process and the finishing grinding process can be performed in a grinding apparatus shown in FIGS. 14 and 15.

In the grinding apparatus shown in FIGS. 14 and 15, a pair of bases 121 and 122 are connected to each other. A workpiece holding mechanism 24 and a grinding mechanism 25 are disposed on the first base 121, so that an outer periphery of a workpiece 23 as a circular thin plate, which is sucked and held by the workpiece holding mechanism 24, is ground by the grinding mechanism 25.

A wafer carrying mechanism 129 including a first moving table 133 and a second moving table 134 is disposed on the second base 122. The first moving table 133 is disposed in such a manner as to be movable between a processing position P3 corresponding to the workpiece holding mechanism 24 and a retreated position P2 at a distance therefrom. Further, the second moving table 134 is supported on the first moving table 133 in such a manner as to be integrally and relatively movable with the first moving table 133. An unprocessed workpiece 23 is carried onto the workpiece holding mechanism 24 by the first moving table 133, and a processed workpiece 23 is carried out from the workpiece holding mechanism 24 by the second moving table 134.

A cover 135 is provided over the two bases 121 and 122 in such a manner as to cover the various mechanism sections on their upper surfaces, and a shutter 136 is disposed in a substantially intermediate portion thereof in such a manner as to be capable of being lowered or raised. During the grinding of the workpiece 23, the shutter 136 is closed so that the portions on the first base 121 and the portions on the second base 122 are separated, thereby preventing a coolant and the like from being scattered to the portions on the base 122. In addition, the shutter 136 is opened when the workpiece 23 is carried in or carried out by the wafer carrying mechanism 129.

In the grinding mechanism 25 of this modification, as shown in FIG. 15, a supporting base 160 for shifting is disposed on the first base 121, and a pair of guide rails 161 for shifting are laid on an upper surface of the supporting base 160 in such a manner as to extend within a horizontal plane in a diagonally shifting direction S from the front on the left-hand side toward the rear on the right-hand side. A shifting base 162 is shiftably supported on the guide rails 161 for shifting, and a pair of X-direction guide rails 163 extending in the left-and-right direction (X direction) within the horizontal plane are laid on an upper surface of the shifting base 162.

A moving base 164 is movably supported on the X-direction guide rails 163 by means of a pair of rolling units, and a pair of Y-direction guide rods 165 extending in the Y direction within the horizontal plane are disposed on an upper portion of the moving base 164. A saddle 166 is movably supported on the Y-direction guide rods 165 by means of hydrostatic bearings. In addition, a processing head 167 is supported on an upper portion of the Y-direction guide rods 165 through a supporting shaft 168 in such a manner as to be capable of swiveling about a vertical axis by means of a motor and a ball screw. A pair of rotating shafts 169 and 170 are projectingly provided on both sides of the processing head 167 in such a manner as to extend in a horizontal direction perpendicular to the axis of the supporting shaft 168, and the rotating shafts 169 and 170 are rotated by a motor 171 accommodated in the processing head 167. Then, the rotating grinding wheel 27 for rough grinding is mounted on the rotating shaft 169, while the rotating grinding wheel 28 for finish grinding is mounted on the other rotating shaft 170. It should be noted that the hydrostatic bearings are used only for the Z and Y axes related to processing for the purpose of the reduction of cost. But, the hydrostatic bearings may be used also at the time of relatively moving the rotating grinding wheels 27 and 28 in the X direction and in the S direction.

A description will now be given of the advantages which can be expected from the above-described embodiment.

In the method of grinding a workpiece in this embodiment, the workpiece 23 formed of a circular thin plate is rotated about its center as the axis L1, and each of the disk-shaped rotating grinding wheels 27 and 28, while being rotated about the axis L3 substantially parallel to the plane of the workpiece 23, is made to undergo relative and continuous feeding movement along at least one part of both obverse and reverse surface sides of the workpiece 23 on the outer peripheral edge portion 23*a* of the workpiece 23. Consequently, the outer peripheral edge portion 23*a* of the workpiece 23 is ground by the outer peripheral wheel surface of each of the rotating grinding wheels 27 and 28.

For this reason, as compared with the conventional grinding method in which the outer peripheral edge portion of the workpiece is ground by a forming grinding wheel, the profile of the wheel surface of each of the rotating grinding wheels 27 and 28 is less prone to deformation, so that it becomes unnecessary to replace the rotating grinding wheels 27 and 28 frequently. Accordingly, it is possible to reduce the material cost of the rotating grinding wheels 27 and 28, and hence the machining cost. Furthermore, since the profile of the wheel surface of each of the rotating grinding wheels 27 and 28 is less prone to deformation, the outer peripheral edge portions 23*a* of the workpieces 23 can be ground into constant machined shapes with high accuracy.

In addition, the edge portion 23*a* of the workpiece 23 can be finished into an arbitrary shape by the same grinding wheels 27 and 28 through the relative feeding control of the workpiece 23 and the rotating grinding wheels 27 and 28.

In the method of grinding a workpiece in this embodiment, the axis L3 of the rotating grinding wheels 27 and 28 is disposed in such a manner as to be perpendicular to the radial direction of the workpiece 23. For this reason, the rotation of the workpiece 23 is effected so as to traverse the outer peripheral surface of each of the rotating grinding wheels 27 and 28. In other words, the workpiece 23 undergoes relative movement in the widthwise direction of the rotating grinding wheels 27 and 28. Accordingly, it becomes possible to effectively grind all over the outer peripheral edge portion 23*a* of the workpiece 23 by making effective use of the overall width of the outer peripheral wheel surfaces of the rotating grinding wheels 27 and 28.

In the method of grinding a workpiece in this embodiment, the rotating grinding wheels consist of the two grinding wheels 27 and 28 for rough grinding and finish grinding, and rough grinding and finish grinding are performed by the grinding wheels 27 and 28, respectively. For this reason, the grinding of the outer peripheral edge portion 23*a* of the workpiece 23 can be effected separately for rough grinding and finish grinding and continuously and efficiently with high accuracy.

In the method of grinding a workpiece in this embodiment, the rough grinding and finish grinding of the outer peripheral edge portion 23*a* of the workpiece 23 are performed by the same station. For this reason, it becomes unnecessary to transport the workpiece 23 into another station or shift the holding of the workpiece 23, and it is possible to continuously perform rough grinding and finish grinding for the outer peripheral edge portion 23*a* in the state of being disposed in the same station. Hence, it is possible to maintain the positional accuracy of the workpiece and improve the operating efficiency. Further, stations for rough grinding and finish grinding need not be provided separately, the arrangement of the grinding apparatus can be simplified, and the grinding apparatus can be made compact.

In the method of grinding a workpiece in this embodiment, a rotating grinding wheel which is formed by binding the grains of silicon dioxide into fixed abrasive grains is used as the rotating grinding wheel 28 for finishing. For this reason, the outer peripheral edge portion 23*a* of the workpiece 23 can be ground with good finish-ground surface roughness by virtue of the chemical action based on the reducing action of silicon dioxide.

In the method of grinding a workpiece in this embodiment, the rotating grinding wheel 26 for cylindrical grinding is rotated about the axis L2 parallel to the central axis L1 of the workpiece 23 in the process preceding the grinding by the disk-shaped rotating grinding wheels 27 and 28, so as to roughly cut the outer peripheral edge portion 23*a* of the workpiece 23 by cylindrical grinding. For this reason, since the outer peripheral edge 10 portion 23*a* of the workpiece 23 is subjected to rough cutting in advance in the preceding process, the subsequent grinding of the outer-peripheral edge portion 23*a* of the workpiece 23 can be performed efficiently, thereby making it possible to improve the efficiency of the overall operation. Moreover, cylindrical grinding produces a large amount of grinding per unit time, the rough cutting can be performed efficiently, and since cylindrical grinding is rough cutting, even if the outer peripheral surface of the rotating grinding wheel 26 is slightly broken, machining accuracy remains substantially unaffected, so that the frequent replacement of the grinding wheel is unnecessary.

In the method of grinding a workpiece in this embodiment, after the outer peripheral edge portion 23*a* of the workpiece 23 is subjected to rough grinding and finish grinding by using the rotating grinding wheels 27 and 28, final finishing is performed in another station by using the disk-shaped polishing pad and slurry. For this reason, the pliability of the polishing pad contributes to high-accuracy machining, and the slurry cools the machined portion of the workpiece 23. Hence, it is possible to further enhance the ground surface roughness of the outer peripheral edge portion 23*a* of the workpiece 23 and effect super-finish grinding.

In the method of grinding a workpiece in this embodiment, the rotating grinding wheel 28 for finish grinding, while being rotated in one direction, is moved to be fed toward the outer peripheral edge portion 23*a* of the workpiece 23 starting with its obverse surface side and then toward its tip side, thereby subjecting the obverse surface side of the outer peripheral edge portion 23*a* to finish grinding. Subsequently, the rotating grinding wheel 28, while being rotated in the opposite direction, is moved to be fed toward the outer peripheral edge portion 23*a* of the workpiece 23 starting with its reverse surface side and then toward its tip side, thereby subjecting the reverse surface side of the outer peripheral edge portion 23*a* to finish grinding.

For this reason, it is possible to change the grinding conditions corresponding to the angle of the crystal face appearing in the outer peripheral edge portion 23*a* on the obverse surface side and the reverse surface side of the outer peripheral edge portion 23*a* of the workpiece 23, and it is possible to prevent the occurrence of variations in the roughness of the ground surface between the obverse surface side and the reverse surface side of the outer peripheral edge portion 23*a*. Hence, it is possible to grind the outer peripheral edge portion 23*a* of the workpiece 23 with uniform ground surface roughness and with high accuracy.

In the method of grinding a workpiece in this embodiment, the rotating grinding wheel, while being rotated in one direction, is moved to be fed toward the edge portion of the workpiece starting with its obverse surface side and then toward its tip side, to thereby grind the obverse surface side of the edge portion, and, subsequently, the rotating grinding wheel, while being rotated in the opposite direction, is moved to be fed toward the edge portion of the workpiece starting with its reverse surface side and then toward its tip side, to thereby grind the reverse surface side of the edge portion.

In accordance with this grinding method, since grinding is performed by bisecting an allowance for the obverse and reverse surfaces of the edge portion of the workpiece in such a manner as to depict symmetrical loci of movement on the obverse surface side and the reverse surface side, grinding can be performed by the same change of the grinding conditions for both the obverse and reverse surface sides in correspondence with the angle of the crystalline face appearing at the edge portion, and it is possible to prevent the occurrence of variations in the roughness of the ground surface between the obverse surface side and the reverse surface side of the edge portion. Hence, the edge portion of the workpiece can be ground uniform ground surface roughness with high accuracy. It should be noted that the dividing method is not confined to the bisection, and various dividing methods are conceivable including such as trisection into the obverse surface side, the reverse surface side, and the tip side, and a division into five parts of the obverse surface side, the reverse surface side, the tip side, a region between the obverse surface side and the tip side, and a region between the reverse surface side and the tip side. In such cases as well, the ground surface roughness of the obverse and reverse surface sides can be made uniform.

The present disclosure relates to the subject matter contained in Japanese Patent application Nos. Hei. 11-220019 filed on Aug. 3, 1999 and Hei. 11-91947 filed on Mar. 31, 1999 which are expressly incorporated herein by reference in its entirety.

While only certain embodiments of the invention have been specifically described herein, it will apparent that numerous modifications may be made thereto without departing from the spirit and scope of the invention.

What is claimed is:

1. A method of grinding a workpiece, using a workpiece holding unit that includes a pad holding the workpiece, a rotating shaft attaching the pad at one end thereof, and a cylindrical member rotatably supporting the rotating shaft, comprising the steps of:

rotating the workpiece, formed of a circular thin plate about a center axis thereof, by rotating the rotating shaft and the pad holding the workpiece;

rotating a disk-shaped rotating grinding wheel about an axis thereof disposed substantially parallel to a plane of the workpiece; and performing a relative feeding movement between the workpiece and said grinding wheel such said rotating grinding wheel moves along at least one part of an edge portion of the workpiece in a thickness direction of the workpiece, while concurrently rotating the workpiece and said rotating grinding wheel, whereby an outer peripheral surface of said rotating grinding wheel grinds the edge portion of the workpiece.

2. The method according to claim 1, wherein the axis of said rotating grinding wheel is disposed in such a manner as to be substantially perpendicular to a radial direction of the workpiece.

3. The method according to claim 1, wherein said rotating grinding wheel includes a rotating grinding wheel for rough grinding and a rotating grinding wheel for finish grinding, whereby rough grinding and finish grinding are performed.

4. The method of grinding a workpiece according to claim 3, wherein said rough grinding and said finish grinding are performed in a same station.

5. The method according to claim 3, wherein at least said rotating grinding wheel for finish grinding includes grains of silicon dioxide binded into fixed abrasive grains.

6. The method according to claim 1, wherein an outer peripheral edge portion of the workpiece is ground.

7. The method according to claim 6, wherein a rotating grinding wheel for cylindrical grinding is rotated about an axis thereof disposed substantially parallel to the central axis of the workpiece in a process preceding the grinding by said disk-shaped rotating grinding wheel, so as to effect the rough cutting of the edge portion of the workpiece by cylindrical grinding.

8. The method according to claim 1, wherein an inner peripheral edge portion of the workpiece having a circular hole in a center portion thereof is ground.

9. A method of grinding a workpiece, comprising the steps of:

rough cutting an edge portion of the workpiece formed of a circular thin plate by means of cylindrical grinding, said rough cutting step being obtained by rotating a first rotating grinding wheel for cylindrical grinding about an axis thereof disposed substantially parallel to a center axis of the workpiece, while rotating the workpiece about the center axis of the thereof; and grinding the edge portion of the workpiece by an outer peripheral surface of a second rotating grinding wheel, said grinding step being obtained by performing a relative feeding movement between said second grinding wheel and the workpiece such that the second grinding wheel moves along at least one part of the edge portion of the workpiece in a thickness direction of the workpiece, while rotating said second rotating grinding wheel about an axis extending in a direction substantially parallel to a plane of the workpiece and substantially perpendicular to a radial direction of the workpiece.

10. The method according to claim 9, wherein said second rotating grinding wheel includes a rotating grinding wheel for rough grinding and a rotating grinding wheel for finish grinding, and said grinding step includes rough grinding and finish grinding, which are performed after the rough cutting.

11. An apparatus for grinding a workpiece, comprising:

a workpiece holding unit holding the workpiece formed of a circular thin plate and rotating the workpiece about a center axis thereof;

a grinding unit having a disk-shaped rotating grinding wheel, said grinding unit grinding an edge portion of the workpiece by performing a relative feeding movement between said rotating grinding wheel and the workpiece such that said rotating grinding wheel moves along at least one part of the edge portion of the workpiece in a thickness direction thereof, while rotating said grinding stone about an axis thereof disposed substantially parallel to a plane of the workpiece; and said workpiece holding unit includes:

a pad holding the workpiece;

a rotating shaft attaching said pad at one end thereof; and a cylindrical member rotatably supporting said rotating shaft.

12. The apparatus according to claim 11, further comprising:

a moving mechanism performing the relative movement between said rotating grinding wheel and the workpiece; and a guide mechanism guiding the relative movement of said moving mechanism, said guide mechanism including a hydrostatic bearing.

13. The apparatus according to claim 12, wherein said moving mechanism comprises:

a first moving mechanism performing a first relative linear movement between the workpiece and said rotating grinding wheel; and a second moving mechanism performing a second relative linear movement between the workpiece and said rotating grinding wheel perpendicular to said first relative linear movement.

14. The apparatus according to claim 13, wherein said guide mechanism guiding the first relative movement of said first moving mechanism includes said hydraulic bearing.

15. The apparatus according to claim 14, wherein said guide mechanism guiding the second relative movement of said second moving mechanism includes said hydraulic bearing.

16. The apparatus according to claim 13, wherein said workpiece holding unit includes said first moving mechanism, and said grinding unit includes said second moving mechanism.

17. An apparatus for grinding a workpiece, comprising:

a workpiece holding unit holding the workpiece formed of a circular thin plate and rotating the workpiece about a center axis thereof;

a grinding unit having a disk-shaped rotating grinding wheel, said grinding unit grinding an edge portion of the workpiece by performing a relative feeding movement between said rotating grinding wheel and the workpiece such that said rotating grinding wheel moves along at least one part of the edge portion of the workpiece in a thickness direction thereof, while rotating said grinding stone about an axis thereof disposed substantially parallel to a plane of the workpiece;

a moving mechanism performing the relative movement between said rotating grinding wheel and the workpiece; and a guide mechanism guiding the relative movement of said moving mechanism, said guide mechanism including a hydrostatic bearing;

wherein said moving mechanism comprises:

a first moving mechanism performing a first relative linear movement between the workpiece and said rotating grinding wheel; and a second moving mechanism performing a second relative linear movement between the workpiece and said rotating grinding wheel perpendicular to said first relative linear movement; and wherein said workpiece holding unit includes said first moving mechanism, and said grinding unit includes said second moving mechanism, and wherein said workpiece holding unit includes:

a pad holding the workpiece;

a rotating shaft attaching said pad at one end thereof;

a cylindrical m ember rotatably supporting said rotating shaft; and said hydrostatic bearings disposed between said rotating shaft and said cylindrical member.

18. An apparatus for grinding a workpiece, comprising:

a workpiece holding unit holding the workpiece formed of a circular thin plate and rotating the workpiece about a center axis thereof;

a grinding unit having a disk-shaped rotating grinding wheel, said grinding unit grinding an edge portion of the workpiece by performing a relative feeding movement between said rotating grinding wheel and the workpiece such that said rotating grinding wheel moves along at least one part of the edge portion of the workpiece in a thickness direction thereof, while rotating said grinding stone about an axis thereof disposed substantially parallel to a plane of the workpiece, wherein said grinding unit includes:

a rough cutting unit having the rotating grinding wheel for cylindrical grinding, said rough cutting unit cutting the edge portion of the workpiece by performing a relative linear movement between the grinding wheel and the workpiece, while rotating the grinding wheel and the workpiece in the substantially same plane.

19. The apparatus according to claim 18, further comprising:

a workpiece-outside-diameter measuring sensor measuring an outside diameter of the workpiece cut by said rough cutting unit, wherein said relative linear movement between the other grinding wheel and the workpiece is determined in accordance with the measured outside diameter of the workpiece.

20. The apparatus according to claim 19, wherein said workpiece-outside-diameter measuring sensor performs a zero adjustment for adjusting a relative position between said sensor and the workpiece for measuring.

21. The apparatus according to claim 11, further comprising:

a grinding-wheel-diameter measuring sensor measuring the outside diameter of said rotating grinding wheel, wherein said relative feeding movement is determined in accordance with the outside diameter of said rotating grinding wheel.

22. The apparatus according to claim 21, wherein said grinding-wheel-diameter measuring sensor performs a zero adjustment for adjusting a relative position between said sensor and said rotating grinding wheel for measuring.

23. The apparatus according to claim 11, further comprising:

a vertical position measuring sensor for measuring a vertical elongation of said workpiece holding unit.

* * * * *